US012330209B2

(12) United States Patent
Shimomura et al.

(10) Patent No.: US 12,330,209 B2
(45) Date of Patent: Jun. 17, 2025

(54) CASTING MOLD SHAPING DEVICE AND CASTING MOLD SHAPING METHOD

(71) Applicant: METALS ENGINEERING KABUSHIKI KAISHA, Takaoka (JP)

(72) Inventors: Kouichi Shimomura, Takaoka (JP); Daisuke Funaki, Takaoka (JP); Yuso Kanehira, Takaoka (JP)

(73) Assignee: METALS ENGINEERING KABUSHIKI KAISHA, Takaoka (JP)

( * ) Notice: Subject to any disclaimer, the term of this patent is extended or adjusted under 35 U.S.C. 154(b) by 0 days.

(21) Appl. No.: 18/290,502

(22) PCT Filed: Oct. 13, 2022

(86) PCT No.: PCT/JP2022/038176

§ 371 (c)(1),
(2) Date: Nov. 14, 2023

(87) PCT Pub. No.: WO2023/127226

PCT Pub. Date: Jun. 7, 2023

(65) Prior Publication Data

US 2024/0326121 A1 Oct. 3, 2024

(30) Foreign Application Priority Data

Dec. 27, 2021 (JP) ..... 2021-213100

(51) Int. Cl.
*B22C 11/08* (2006.01)
*B22C 9/02* (2006.01)
(Continued)

(52) U.S. Cl.
CPC ..... *B22C 11/08* (2013.01); *B22C 9/02* (2013.01); *B22C 15/02* (2013.01); *B22C 21/00* (2013.01)

(58) Field of Classification Search
CPC ..... B22C 9/02; B22C 11/08; B22C 15/02; B22C 21/00
(Continued)

(56) References Cited

FOREIGN PATENT DOCUMENTS

JP 58-55149 A 4/1983
JP 5-15946 A 1/1993
(Continued)

OTHER PUBLICATIONS

International Search Report for PCT/JP2022/038176 mailed Dec. 13, 2022.

*Primary Examiner* — Kevin P Kerns
(74) *Attorney, Agent, or Firm* — Schmeiser, Olsen & Watts LLP

(57) ABSTRACT

A casting mold shaping device is provided, comprising a turntable-type carrier plate replacement device; a molding flask carry-in/out device for carrying in a molding flask to a molding space forming position provided in the carrier plate replacement device and carrying out the molded molding flask; a molding flask carrier plate stacking device for stacking the molding flask which as been carried in and each carrier plate to form a molding space; a casting sand filling device for filling the molding space with the casting sands; a molding station provided so as to be adjacent to the molding space forming position and including a casting sand pressing device for pressing the casting sands to make a mold; and a molding flask carrier plate moving device for moving the carrier plate and the molding flask in stacking state from the molding space forming position to the molding station.

13 Claims, 19 Drawing Sheets

(51) Int. Cl.
*B22C 15/02* (2006.01)
*B22C 21/00* (2006.01)

(58) Field of Classification Search
USPC ..... 164/37, 159, 169, 181, 207
See application file for complete search history.

(56) References Cited

FOREIGN PATENT DOCUMENTS

| | | | |
|---|---|---|---|
| JP | 7-303936 | A | 11/1995 |
| JP | 2001-512048 | A | 8/2001 |
| JP | 2017070982 | A | 4/2017 |
| JP | 2019042751 | A | 3/2019 |
| JP | 6577321 | B2 | 9/2019 |
| WO | 2011108071 | A1 | 9/2011 |

CASTING MOLD SHAPING DEVICE AND CASTING MOLD SHAPING METHOD

CROSS-REFERENCE TO RELATED APPLICATIONS

This application claims priority to PCT Application No. PCT/JP2022/038176, having a filing date of Oct. 13, 2022, based on Japanese Application No. 2021-213100, having a filing date of Dec. 27, 2021, the entire contents both of which are hereby incorporated by reference.

FIELD OF TECHNOLOGY

The following relates to a casting mold shaping device for making a mold by using casting sands and a casting mold shaping method therefor.

BACKGROUND

In order to make a mold, the inside of a molding space formed by a pattern surface plate on which a pattern is placed and fixed, and a molding flask, is filled with casting sands. By pressing the charged casting sands and extracting the pattern therefrom, a mold made of sands is formed.

As a casting mold shaping device for manufacturing such a mold, JP Publication No. 6577321B2 describes a molding station and a pattern replacement station for alternately replacing an upper mold carrier plate and a lower mold carrier plate to which a pattern and a pattern surface plate are fixed, with respect to the molding station, by a turntable method. Furthermore, molding flask carry-in/out lines for carrying in a molding flask to the molding station are provided in the molding station in such an arrangement that these lines intersect.

In the pattern replacement station, each carrier plate having the upper and lower patterns the molding of which has reached the scheduled molding number, is carried out, and a carrier plate on which a pattern for the next molding is fixed in advance, is carried in. By automating these steps, an excellent device is obtained such that the pattern replacement is completed during the molding in the molding station and the occurrence of delay is prevented in the molding cycle.

However, since the molding flask carry-in/out lines intersect in the molding station, it is necessary to prevent interference between a pattern upper end surface and a mold protrusion on the molding flask lower surface side when turning the carrier plate having the pattern fixed thereon in the pattern replacement station. Accordingly, the distance between the pattern upper end surface and the molding flask lower surface is set to be large.

In addition, in the molding station, holding is achieved with a gap provided between the molding flask and the upper filling frame which are arranged in the up-down direction, and in the setting, a gap is also required between the lower surface of the squeezing head and the upper surface of the upper filling frame.

Furthermore, in the setting, a gap is also required between the lower surface of the carrier plate and the upper surface of the squeezing table.

Here, the total length of the gaps needs to be added to a stroke of a cylinder device for raising and lowering the squeezing table. However, the output of the cylinder device having a large pressurizing force is originally required only in a range in which the casting sands in the molding flask are compressed, and the stroke corresponding to the gap is useless as power for driving the cylinder device. JP 2001-512048A describes an apparatus for separating a pattern and a sand mold formed in the molding flask by the pattern from each other.

In JP 2001-512048A, only a step of compressing the casting sands is performed in the molding station, while the casting sands are charged to the molding flask and the molding flask is released after the completion of the squeezing in a pattern replacement unit. Therefore, the stroke of a pressurizing device in the molding station is short, and wasteful power is reduced.

However, in JP Publication No. 2001-512048A, the pattern replacement unit for replacing an upper mold carrier plate and a lower mold carrier plate is provided with the molding station on the lateral side at the center of the linear-shaped pattern replacement unit, and the molding flask conveyance line (an empty molding flask is carried in and the molding flask after the squeezing is carried out) is placed to stackabove the pattern replacement unit.

Therefore, when the pattern replacement unit performs the replacement with a new carrier plate, as in 36a and 36b in FIG. 4 of JP Publication No. 2001-512048A, it is necessary to carry out carrier plates to two dedicated positions deviated in a 90-degree direction from both ends of the linear-shaped pattern replacement unit. Necessary auxiliary work such as cooling metal and facing sand covering should be performed at these two dedicated positions.

Therefore, extra labor and time are required for performing carry-out carrier plates to the two dedicated positions deviated by 90 degrees from the pattern replacement unit and performing carry-in carrier plates from the dedicated positions.

SUMMARY

An aspect relates to a casting mold shaping device and a casting mold shaping method that reduce a wasteful stroke for squeezing and improve the efficiency of the carrier plate replacement work and the auxiliary work.

A casting mold shaping device according to a first aspect of embodiments of the present invention include a carrier plate replacement device for mounting an upper molding flask carrier plate at one position on a virtual horizontal plane and a lower molding flask carrier plate at the other position on the horizontal plane, and replacing the upper molding flask carrier plate and the lower molding flask carrier plate by turning along the horizontal plane between an auxiliary work position at which an auxiliary work is performed on each of the carrier plates and a molding space forming position at which a molding space for filling casting sands is formed by stacking a molding flask on each of the carrier plates.

A molding flask carry-in/out device for carrying in the molding flask before molding to be stacked on the carrier plate to the molding space forming position and carrying out the molding flask after molding from which a mold is made, and a molding flask carrier plate stacking device for stacking the molding flask carried in by the molding flask carry-in/out device on the carrier plate to form the molding space, are also provided.

The casting mold shaping device also includes a casting sand filling device for filling the formed molding space with the casting sands, a molding station provided so as to be adjacent to the molding space forming position and including a casting sand pressing device for pressing the casting sands charged to the molding space to make a mold, and a molding flask carrier plate moving device for moving the carrier plate and the molding flask in stacking state from the molding space forming position to the molding station.

Thereby, only a step of pressing the casting sands is performed in the molding station, and it is possible to shorten the stroke of the casting sand pressing device in the molding station and reduce wasteful power.

Furthermore, it is possible to perform the replacement work of the carrier plate and the auxiliary work at one place, that is an auxiliary work position, thereby improving the work efficiency.

According to a casting mold shaping device of a second aspect of embodiments of the present invention, in the casting mold shaping device according to the first aspect, the molding station is placed on a straight line formed by the auxiliary work position and the molding space forming position.

Thereby, it is possible to perform the auxiliary work on the carrier plate to be replaced at the auxiliary work position, and carry in the molding flask and the carrier plate which have been stacked in the molding space forming position, to the molding station in the shortest distance and the shortest time without a useless path.

According to a casting mold shaping device of a third aspect of embodiments of the present invention, in the casting mold shaping device according to the first or second aspect, a side slip preventing device is provided, at the molding space forming position, for preventing, when the molding flask and the carrier plate are stacked, the molding flask and the carrier plate in stacking state from slipping from each other in a horizontal direction.

Thereby, it is possible to prevent the molding flask and the carrier plate which have been stacked from horizontally slipping when being moved to the molding station.

According to a casting mold shaping device of a fourth aspect of embodiments of the present invention, in the casting mold shaping device according to the third aspect, the side slip preventing device is provided in the molding flask carrier plate stacking device.

Thereby, since the side slip preventing device is provided in the molding flask carrier plate stacking device, it is possible to easily and reliably prevent side slip without providing an additional dedicated device.

According to a casting mold shaping device of a fifth aspect of embodiments of the present invention, in the casting mold shaping device according to the fourth aspect, the molding flask carrier plate stacking device includes a stacking device transfer mechanism in which the molding flask carrier plate stacking device moves to the molding station together with the molding flask and the carrier plate which have been stacked, when the molding flask and the carrier plate are moved by the molding flask carrier plate moving device.

Thereby, at the time of shifting from the raising/lowering operation for stacking the molding flask on the carrier plate to the traverse operation, transfer performed by the additional device is not required, whereby it is possible to shorten the transfer time and simplify the apparatus.

According to a casting mold shaping device of a sixth aspect of embodiments of the present invention, in the casting mold shaping device according to any one of the first to fifth aspects, the molding station is provided with a molding station conveyor, which is a roller conveyor extending in a direction of the carrier plate replacement device, and a moving roller conveyor that aligns with the molding station conveyor when having been positioned at the molding space forming position is provided at a position, in the carrier plate replacement device, for mounting the carrier plate.

Thereby, it is possible to easily and reliably move the molding flask and the carrier plate in a state where the molding flask is being stacked on the carrier plate, between the molding space forming position and the molding station.

According to a casting mold shaping device of a seventh aspect of embodiments of the present invention, in the casting mold shaping device according to the fifth aspect, the stacking device transfer mechanism includes: a groove having an insertion portion at an end and provided in the molding flask carrier plate stacking device so as to extend in a longitudinal direction; a slider that is inserted from the insertion portion and slides along the groove; a rotating shaft provided in a structure body of the molding station; a crank arm that rotates about the rotating shaft along a virtual vertical plane including the groove between the molding space forming position and the molding station, and causes the slider to move back and forth in the groove; and a rotary driving device that rotates the crank arm, and the slider is inserted to the groove from the insertion portion when the molding flask is stacked on the carrier plate.

Thereby, when the molding flask is stacked on the carrier plate, the slider is inserted to the groove, and the molding flask, the carrier plate, and the molding flask carrier plate stacking device are movable toward the molding station due to the rotation of the crank arm. In this manner, it is possible to instantaneously communicate the lowering operation and the lateral movement operation of the molding flask, and perform the lateral movement operation to the molding station quickly and reliably.

According to a casting mold shaping device of an eighth aspect of embodiments of the present invention, in the casting mold shaping device according to any one of the first to seventh aspects, the casting sand pressing device in the molding station lowers a casting sand pressing member provided on an upper side of the molding flask to squeeze the casting sands.

Thereby, since the casting sand pressing device applies pressure to the casting sands by lowering the casting sand pressing member from above the molding flask stacked on the carrier plate, there is no need for a space to install a driving device (for example, a squeezing table and a large cylinder device for raising the squeezing table) below the carrier plate, whereby space saving is achieved, and the pit depth for accommodating such a driving device can be shortened. In addition, since a large pressing device is located on the ground, maintainability is also improved.

According to a casting mold shaping device of a ninth aspect of embodiments of the present invention, in the casting mold shaping device according to the sixth aspect, the carrier plate replacement device includes, at a position where each of the carrier plates is to be mounted, a locking device that prevents the movement of each of the carrier plates outwardly in a radial direction which occurs when the carrier plate replacement device is turning.

Thereby, it is possible to prevent the movement of the carrier plate due to a centrifugal force when the carrier plate replacement device turns by the locking device.

According to a casting mold shaping device of a tenth aspect of embodiments of the present invention, in the casting mold shaping device according to the sixth aspect, the molding station is provided with a squeezing table capable of receiving, on an upper surface thereof, the molding flask and the carrier plate which have been stacked, and a conveyor raising/lowering device that lowers the molding station conveyor to a position lower than the upper surface of the squeezing table when the casting sands are pressed by the casting sand pressing device.

Thereby, it is possible to avoid an overload on the molding station conveyor as the carrier plate seats on the upper surface of the squeezing table at the time of pressing the casting sands.

According to a casting mold shaping device of an eleventh aspect of embodiments of the present invention, in the casting mold shaping device according to any one of the first to tenth aspects, the casting sand filling device is provided so as to fit the molding space forming position.

Thereby, it would be particularly easy to install a free-fall-type casting sand filling device by placing the casting sand filling device at the molding space forming position, and it is possible to scrap off excess sands after the completion of charging when the molding flask and the carrier plate which have been stacked are moved to the molding station, without providing a special mechanism.

According to a casting mold shaping device of a twelfth aspect of embodiments of the present invention, in the casting mold shaping device according to any one of the first to tenth aspects, the casting sand filling device is provided so as to fit a position of the molding station.

Thereby, it would be easy to install, particularly, a blowing-type casting sand filling device by placing the casting sand filling device in the molding station, and it is possible to avoid the occurrence of excess sands after the completion of charging.

A casting mold shaping method according to a thirteenth aspect of embodiments of the present invention includes a carrier plate replacement step for mounting an upper molding flask carrier plate at one position on a virtual horizontal plane and a lower molding flask carrier plate at the other position on the horizontal plane, and replacing the upper molding flask carrier plate and the lower molding flask carrier plate by turning along the horizontal plane between an auxiliary work position at which an auxiliary work is performed on each of the carrier plates and a molding space forming position at which a molding space for filling casting sands is formed by stacking a molding flask on each of the carrier plates.

A molding flask carry-in step for carrying in the molding flask before molding to be stacked on each of the carrier plates to the molding space forming position by a molding flask carry-in device, and a molding flask carrier plate stacking step for stacking the molding flask carried in by the molding flask carry-in device and each of the carrier plates to form the molding space, are also provided.

A casting sand filling step for filling the formed molding space with the casting sands, a molding flask carrier plate moving step for moving the carrier plate and the molding flask in stacking state to the molding station provided so as to be adjacent to the molding space forming position, and a casting sand pressing step for pressing the casting sands charged to the molding space to make a mold by using a casting sand pressing device provided in the molding station, are also provided.

Thereby, only the step of pressing the casting sands is performed in the molding station, and it is possible to shorten the stroke of the casting sand pressing device in the molding station and reduce wasteful power.

Furthermore, it is possible to perform the replacement work of the carrier plate and the auxiliary work at one place, that is an auxiliary work position, thereby improving the work efficiency.

BRIEF DESCRIPTION

Some of the embodiments will be described in detail, with reference to the following figures, wherein like designations denote like members, wherein.

DETAILED DESCRIPTION

A first embodiment of a casting mold shaping device and a casting mold shaping method according to the present invention will be explained below with reference to FIGS. 1 to 17.

Figure 1:
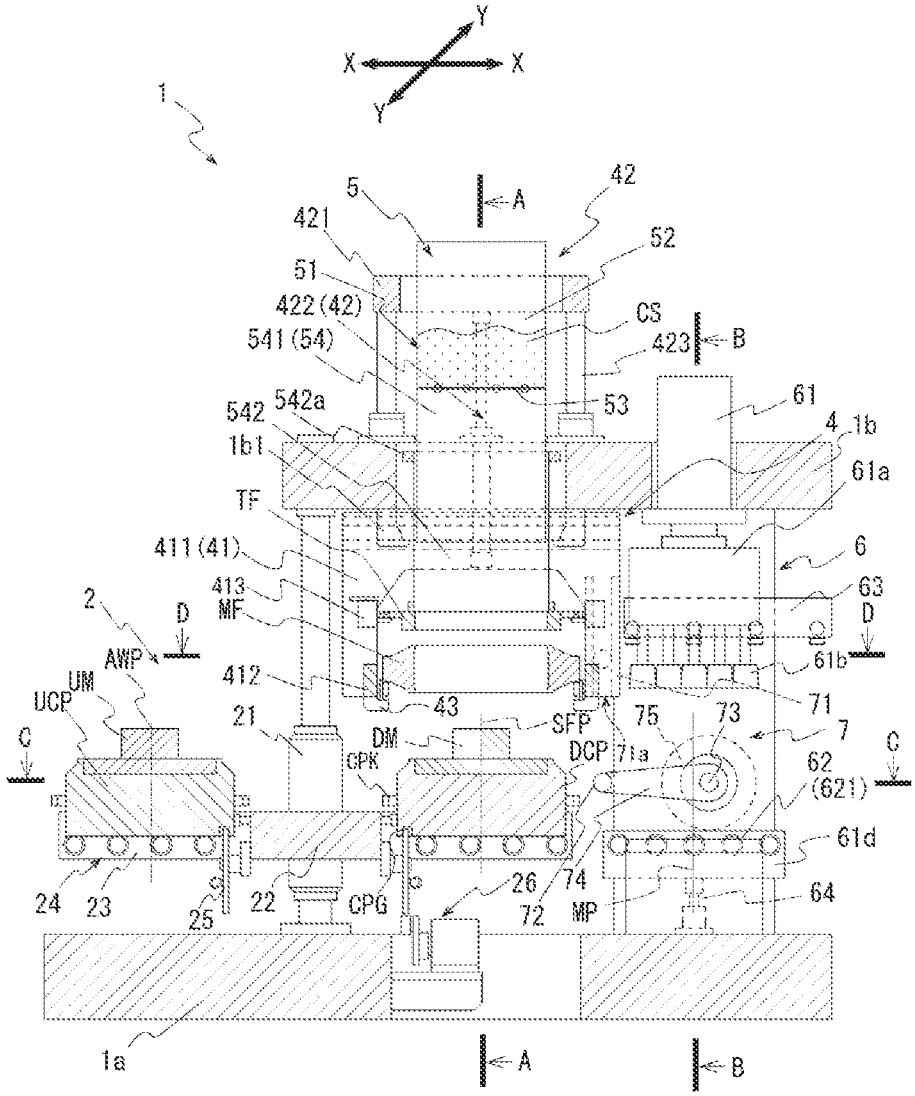
FIG. 1 is a schematic view illustrating a first embodiment of the casting mold shaping device of the present invention as viewed from a front side.

As illustrated in FIG. 1, the casting mold shaping device 1 according to the first embodiment includes a carrier plate replacement device 2, a molding flask carry-in/out device 3, a molding flask carrier plate stacking device 4, a casting sand filling device 5, a molding station 6, and a stacking device transfer mechanism 7.

Note that, a horizontal direction in which the carrier plate replacement device 2 and the molding station 6 are arranged on a straight line is defined as an X direction, and a horizontal direction perpendicular to the X direction is defined as a Y direction. When there is an object to be conveyed, a virtual center line along a conveyance direction thereof is assumed, and a side close to the center line is referred to as the "inner side", whereas a side far from the center line is referred to as an "outer side".

In the conveyance of a molding flask, a starting point side of the conveyance is referred to as an upstream side, whereas an end point side of the conveyance is referred to as a downstream side.

(Carrier Plate Replacement Device)

The carrier plate replacement device 2 is provided to replace a carrier plate CP on which an upper mold pattern UM or a lower mold pattern DM used in the molding station 6 is fixed to the upper surface thereof, between an auxiliary work position AWP and a molding space forming position SFP.

The carrier plate replacement device 2 includes a rotary peripheral wall 21, a support rectangular body 22, a support frame 23, and a rotary driving mechanism (not illustrated).

The rotary peripheral wall 21 is formed in a cylindrical shape, and is externally fitted to a round bar pillar of a structure body via a bearing (not illustrated) in a rotatable manner.

A support rectangular body 22 which has a rectangular shape extending in the horizontal direction is assembled to a lower part in the center of the rotary peripheral wall 21 so as to be relatively immovable.

Two support frames 23 provided to extend in parallel with each other are fixed to the support rectangular body 22 along two opposing sides of the support rectangular body 22. At both ends of the support frame 23, a plurality (four pairs for each end in embodiments) of roller conveyors 24 (moving roller conveyors) are provided so as to face one another on the inner side. The rotary peripheral wall 21 moves back and forth while rotating normally and reversely by 180 degrees by a rotary driving device (not illustrated) including an electric motor, a transmission, and the like. The operation of the electric motor is controlled by a control device (not illustrated).

(Locking Device)

A locking device 25 is provided in the support rectangular body 22 of the carrier plate replacement device 2. The locking device 25 prevents each carrier plate CP from moving from the mount position by a centrifugal force toward an outer side in the radial direction which occurs when the carrier plate replacement device 2 is turning.

The locking device 25 includes a fixing base plate 251, a locking lever 252, and a locking lever energizing device 253 provided in the carrier plate replacement device 2, a to-be-locked groove CPG provided at the lower end on the radially outside of the carrier plate CP arranged in the carrier plate replacement device 2, and a releasing device 26 provided on a base 1*a* of the structure body.

The fixing base plate 251 is made of, for example, iron and is formed in a rectangular plate shape, and is fixed to a lower part of the end surface, on the roller conveyor 24 side, of the support rectangular body 22 such that a wide area portion of the plate is perpendicular thereto. A central support shaft 251*a* extending along a direction parallel to the support frame 23 is provided in a central portion of the fixing base plate 251. Furthermore, a stopper projection 251*b* having a rectangular columnar shape is provided to project from one (on the right side in FIG. 2) of the lower corners of the fixing base plate 251.

The locking lever 252 is rotatably provided to the central support shaft 251*a*. The locking lever 252 is made of, for example, iron and is formed in a long plate shape in which a central portion is swelled, the central support shaft 251*a* is provided in the swelled central portion, and an end of the long plate shape includes an upper side portion 252*a* along a straight line extending in a direction of a tangential line of a virtual concentric circle with respect to the central support shaft 251*a*, and a lower side portion 252*b* provided parallel to the upper side portion 252*a* at a position facing the upper side portion 252*a*. The length from the central support shaft 251*a* to the upper side portion 252*a* is set to be shorter than the length from the central support shaft 251*a* to the lower side portion 252*b*.

A first locking hole is provided on a lateral portion of the locking lever 252 on the lower side portion 252*b* side with respect to the central support shaft 251*a*. A hanging member 254 hanging down from the support rectangular body 22 via a bracket (not illustrated) is provided so as to face the locking lever 252. A second locking hole is provided at a lower end portion of a hanging member 254 so as to face a first locking hole, and a helical spring (locking lever energizing device 253) is stretched between the first locking hole and the second locking hole. The locking lever 252 is energized in the counterclockwise direction in FIG. 2 by the helical spring (locking lever energizing device 253).

Figure 2:
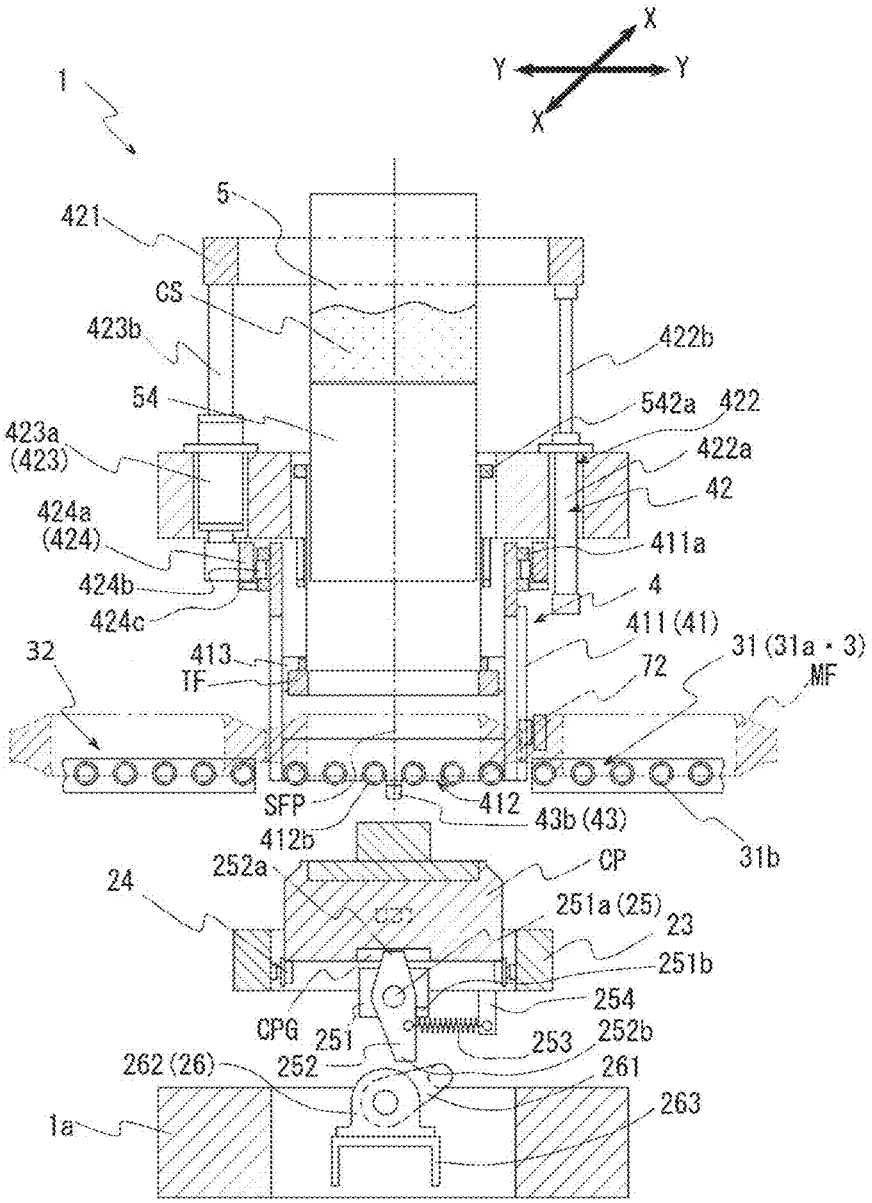
FIG. 2 is a cross-sectional view taken along line A-A in FIG. 1.
Figure 3:
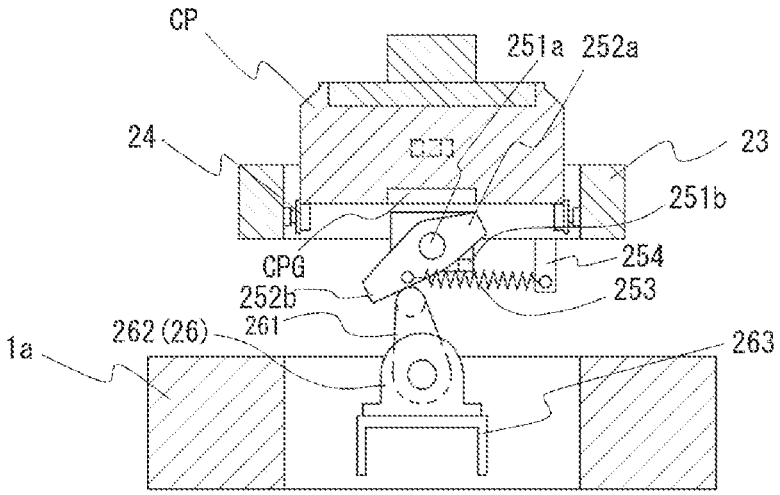
FIG. 3 is a view illustrating a state in which a locking device is released by a releasing device.

At the time of locking, as illustrated in FIG. 2, the upper side portion 252*a* of the locking lever 252 is fitted into the to-be-locked groove CPG. Then, the lateral surface, on the helical spring side, of the locking lever 252 comes into contact with the stopper projection 251*b* so as to stop the rotation of the locking lever 252.

The locking state by the locking device 25 is released by the releasing device 26.

(Releasing Device)

As illustrated in FIG. 1, the releasing device 26 is provided below the carrier plate replacement device 2 and on the molding station 6 side so as to face the locking device 25. The releasing device 26 is housed in a pit provided on the base 1*a* of the structure body.

As illustrated in FIG. 2, the releasing device 26 includes a rotating arm 261, a rotary driving unit 262, and a support base 263. The rotating arm 261 rotates about the output shaft of the rotary driving unit 262 in the same plane as the locking lever 252 disposed so as to be opposed thereto. A roller is provided at the tip of the rotating arm 261 and smoothly rolls to rotate the locking lever 252 in the release direction when coming into contact with the locking lever 252 (see FIG. 3). The rotary driving unit 262 is configured by, for example, an electric motor, and rotates the rotating arm 261 normally and reversely via a deceleration device. The operation of the electric motor is controlled by the control device (not illustrated).

The support base 263 is made of, for example, iron and is formed of a member having a U-shape cross-section. The support base 263 is disposed so as to open at a bottom part thereof and provided to project from a wall in the pit so as to extend in the X direction. The rotary driving unit 262 is fixed to the upper surface of the support base 263 with, for example, a bolt and a nut (not illustrated).

(Molding Flask Carry-In Device, Molding Flask Carry-Out Device)

As illustrated in FIG. 2, the molding flask carry-in/out device 3 includes a molding flask carry-in device 31 and a molding flask carry-out device 32.

The molding flask carry-in device 31 carries in a molding flask MF used for molding to a position before the molding space forming position SFP.

The molding flask carry-out device 32 carries out the molding flask MF which has been molded and accompanied with a sand mold from a position adjacent to the downstream side of the molding space forming position SFP toward the subsequent step.

The molding flask carry-in device 31 and the molding flask carry-out device 32 are roller conveyors, and include a support member 31*a* extending in the Y direction, and a plurality of rollers 31*b* provided so as to face one another on the inner side of the support member 31*a*. A plurality of molding flasks MF to be carried in/out are arranged by, for example, a pusher device and a cushion device (not illustrated) and conveyed.

At the molding space forming position SFP, the molding flask MF being carried in is delivered to the molding flask carrier plate stacking device 4.

(Molding Flask Carrier Plate Stacking Device)

The molding flask carrier plate stacking device 4 includes a molding flask conveyance frame 41, a molding flask conveyance frame raising/lowering device 42, and a side slip preventing device 43.

(Molding Flask Conveyance Frame)

The molding flask conveyance frame 41 is disposed between the downstream end of the molding flask carry-in device 31 and the upstream end of the molding flask carry-out device, and is configured to be laterally movable in the up-down direction and in a direction toward the molding station 6. The molding flask MF which has been carried in by the molding flask carry-in device 31 is received, and the molding flask MF from which a mold is made in the molding station 6 is delivered to the molding flask carry-out device 32.

The molding flask conveyance frame 41 includes a frame main body 411, a roller conveyor unit 412, and an upper filling frame holding unit 413.

The frame main body 411 is made of, for example, iron and is formed by causing two plate materials formed in a substantially H shape so as to be opposed to each other. On both sides of the upper outer side of the frame main body 411, engagement ridges 411*a* to be engaged with a molding flask conveyance frame raising/lowering device 42 described later are provided in two up and down stages so as to extend along the X direction.

The engagement ridges 411*a* in the two stages on the both sides are engaged with a first upper roller conveyor unit 424 described later so as to be movable in the X direction.

(Upper Filling Frame Holding Unit)

On the inner side of the intermediate portion of the frame main body 411, the upper filling frame holding unit 413 is provided. The upper filling frame holding unit 413 is formed of rectangular plate materials (not illustrated) on the inner wall of the frame main body 411 so that a wide area portion of each plate protrudes inward along the horizontal direction. The plate materials are disposed so as to face the inner wall of the frame main body 411. A columnar engagement protrusion (not illustrated) is provided on the upper surface of each plate material so as to protrude upward. The engagement protrusions correspond to to-be-engaged portions of the upper filling frame TF described later so as to be engaged therewith.

(Upper Filling Frame)

The upper filling frame TF is stacked and held on the molding flask MF so that the casting sand CS, which is put into the molding space in extra to use the pressing stroke for squeezing, does not spill out. After the molding is finished in the molding flask MF, the upper filling frame TF is removed from the molding flask MF.

The upper filling frame TF is formed in a rectangular frame shape. The to-be-engaged portions (not illustrated) protruding outward in the X direction are respectively provided at four corners of the upper filling frame. With the to-be-engaged portion, the upper filling frame TF is held by the engagement protrusion of the upper filling frame holding unit 413 while being engaged therewith in an attachable/detachable manner.

(Roller Conveyor Unit)

The roller conveyor unit 412 is provided in a lower part of the frame main body 411. The roller conveyor units 412 are bridged horizontally between as a pair in lower parts of the two opposing frame main bodies 411. Similar to the roller conveyors in the molding flask carry-in device 31 and the molding flask carry-out device 32, the roller conveyor unit 412 includes a support member 412*a* extending in the Y direction, and a plurality of rollers 412*b* provided so as to face one another on the inner side of the support member. The roller conveyor unit 412 is configured to align with the roller conveyors in the molding flask carry-in device 31 and the molding flask carry-out device 32 when the frame main body 411 is at the rising end position (see FIG. 6).

(Side Slip Preventing Device)

The side slip preventing device 43 includes a long plate-shaped holding portion (not illustrated) and a plate engagement portion 43*b*. The long plate-shaped holding portion (not illustrated) is provided along the support member 412*a* of the roller conveyor unit 412 so as to extend in the Y direction at the lower parts of the opposing frame main bodies 411. The plate engagement portion 43*b* is formed in a quadrangular rod shape, protrudes downward at the lower part in the central portion of the long plate-shaped holding portion, and is formed by being further bent inward by 90 degrees. The plate engagement portion 43*b* is provided so as to protrude inward from below the central portion of the support member 412*a* of the roller conveyor unit 412.

The plate engagement portion 43*b* is engaged with a to-be-engaged portion CPK of the carrier plate CP described later.

(Carrier Plate)

In the carrier plate CP, a pattern surface plate to which a pattern is fixed, is assembled on the upper surface thereof, and the molding flask MF and the upper filling frame TF are stacked therewith to form a molding space.

The carrier plate CP is made of, for example, iron and formed in a rectangular thick plate shape, and an engaging portion (not illustrated) for fixing the pattern surface plate is provided on the upper surface thereof.

On each lateral surface of the carrier plates CP arranged in the X direction, a to-be-engaged portion CPK that opens in the lateral direction to form a substantially U shape when viewed from above are provided so as to project therefrom.

The carrier plate CP is provided with a to-be-locked groove CPG.

The to-be-locked groove CPG is provided on the inner bottom surface, of the carrier plate CP disposed in the carrier plate replacement device 2, in the radial direction when the carrier plate replacement device 2 turns, so as to have a predetermined length in the tangential direction of an orbital circle when the carrier plate replacement device 2 turns.

(Molding Flask Conveyance Frame Raising/Lowering Device)

The molding flask conveyance frame raising/lowering device 42 lowers the molding flask conveyance frame 41 to place the upper filling frame TF and the molding flask MF so as to be stacked on the carrier plate CP. After the molding, the molding flask MF and the upper filling frame TF are raised and removed from the carrier plate CP.

The molding flask conveyance frame raising/lowering device 42 is provided on a top plate portion 1*b* of the structure body, and includes a raising/lowering support frame 421, a raising/lowering cylinder device 422, and a raising/lowering guide 423.

The raising/lowering support frame 421 is made of, for example, iron and is formed in a rectangular frame shape, and is provided above the top plate portion 1*b* so as to extend along a horizontal plane. Tips of piston rods 422*b* of the raising/lowering cylinder devices 422 described later are respectively assembled to the central lower surfaces of side portions, of the raising/lowering support frames 421, facing one another in the Y direction.

The raising/lowering cylinder devices 422 are provided as a pair and each include a cylinder portion 422*a*, the piston rod 422*b*, and a hydraulic pump (which are not illustrated) as well as an electromagnetic switching valve (which are not illustrated).

The cylinder portion 422*a* is formed in a cylindrical shape and is fixed while penetrating through the top plate portion 1*b*. On the opening side of the cylinder portion 422*a*, the piston rod 422*b* is inserted so as to be able to advance and retreat along the up-down direction. The cylinder portion 422*a* communicates with the hydraulic pump via an oil feeding pipe (not illustrated). The electromagnetic switching valve (not illustrated) is provided between the cylinder portion 422*a* and the hydraulic pump. The operation of the electromagnetic switching valve is controlled by the control device (not illustrated).

Tips of guide rods 423*b* of the raising/lowering guide 423 are respectively assembled to four corners of the raising/lowering support frame 421. The raising/lowering guide 423 includes a cylindrical guide portion 423*a* and the guide rod 423*b*, and includes a first upper roller conveyor unit 424 at a lower end thereof.

Each cylindrical guide portion 423*a* is formed in a cylindrical shape in which an upper end portion and a lower end portion are opened, and is fixed while penetrating through the top plate portion 1*b*. The rod-shaped guide rod 423*b* is slidably inserted to the cylindrical guide portion 423*a*. As described above, the tip of the guide rod 423*b* is assembled to the lower surface of the raising/lowering support frame 421 so as to be relatively immovable.

The first upper roller conveyor unit 424 is provided at the lower end portion of the guide rod 423*b*.

(First Upper Roller Conveyor Unit)

As illustrated in FIG. 2, the first upper roller conveyor unit 424 includes two first upper roller support members 424*a* extending along the X direction, a plurality of rollers 424*b* provided so as to face one another on the inner side of the two first upper roller support members 424*a*, and a plurality of side rollers 424*c* provided side by side on the lower surface of each first upper roller support members 424*a*. The first upper roller support member 424*a* is bridged horizontally between lower ends of the guide rods 423*b* arranged in the X direction.

(Casting Sand Filling Device)

The casting sand filling device 5 according to the present embodiment is disposed at the molding space forming position SFP.

The casting sand filling device 5 stores, as one unit, casting sands CS required for making a mold to be molded at a time, and charges the casting sands CS to a molding space formed by stacking the upper filling frame TF and the molding flask MF (either one of the upper molding flask and the lower molding flask) with the carrier plate CP to fill the molding space.

The casting sand filling device 5 includes a hopper 51. The hopper 51 includes a sand weighing unit 52, a gate plate 53, and a shooter part 54.

The hopper 51 is made of, for example, iron and the entire shape thereof is formed in a square cylinder. The sand weighing unit 52 is located above the hopper 51 and is separated from the shooter part 54 by the gate plate 53. The casting sands CS are conveyed to and stored in the sand weighing unit 52 by a conveyor device (not illustrated).

The plurality of gate plates 53 are respectively formed in, for example, a rectangular flat plate made of iron, and are arranged in the X direction so as to partition off the inside of the hopper 51 vertically. Each gate plate 53 is rotated about a horizontal axis extending in the Y direction by a rotary device (not illustrated). When the gate plate 53 is positioned at a horizontal position, the inside of the hopper 51 is vertically partitioned off so that it is possible to store the casting sands CS in the sand weighing unit 52. When the gate plate is positioned at the vertical position, the stored casting sands CS freely fall and fill the molding space formed by the upper filling frame TF, the molding flask MF, and the carrier plate CP. The shooter part 54 includes a first shooter part 541 and a second shooter part 542 each formed in a square tubular shape. The first shooter part 541 is continuous with the sand weighing unit 52 and extends downward by a predetermined dimension. The second shooter part 542 is externally fitted to the first shooter part 541, and slides up and down with respect to the first shooter part 541 so as to extend the shooter part 54 downward.

When the molding flask conveyance frame raising/lowering device 42 is at the rising end, the lower end surface of the second shooter part 542 comes in contact with the upper surface of the upper filling frame TF held by the molding flask conveyance frame 41. When the molding flask conveyance frame 41 is lowered by the molding flask conveyance frame raising/lowering device 42, the second shooter part 542 is lowered along with the lowering of the upper filling frame TF while being in contact with the upper filling frame TF. When the molding flask conveyance frame raising/lowering device 42 reaches the lowering end, the upper filling frame TF is stacked on the molding flask MF to form a stacked frame. A to-be-hooked strip 542*a* is provided around the outer edge of the upper end of the second shooter part 542. The to-be-hooked strip 542*a* is hooked on a hooking claw 1*b*1 suspended from the lower surface of the top plate portion 1*b* so as to surround the second shooter part 542, whereby the lower end portion of the second shooter part 542 is not lowered below the upper surface of the upper filling frame TF.

(Stacking Device Transfer Mechanism)

The stacking device transfer mechanism 7 moves the molding flask carrier plate stacking device 4 to the molding station 6 together with the upper filling frame TF, the molding flask MF, and the carrier plate CP which are stacked.

The stacking device transfer mechanism 7 includes a groove 71, a slider 72, a rotating shaft 73, a crank arm 74, and a rotary driving device 75.

The groove 71 is provided perpendicularly at the end, on the molding station 6 side, of the molding flask conveyance frame 41 of the molding flask carrier plate stacking device 4. The groove 71 includes two walls extending in the vertical direction as well as arranged in the X direction. The two walls are provided at the end, on the molding station 6 side, of the molding flask conveyance frame 41 so as to protrude in the Y direction on the upstream side. The slider 72 slides between the two walls. The lower end portion of the groove 71 is open and constitutes an insertion portion 71*a*.

Figure 16:
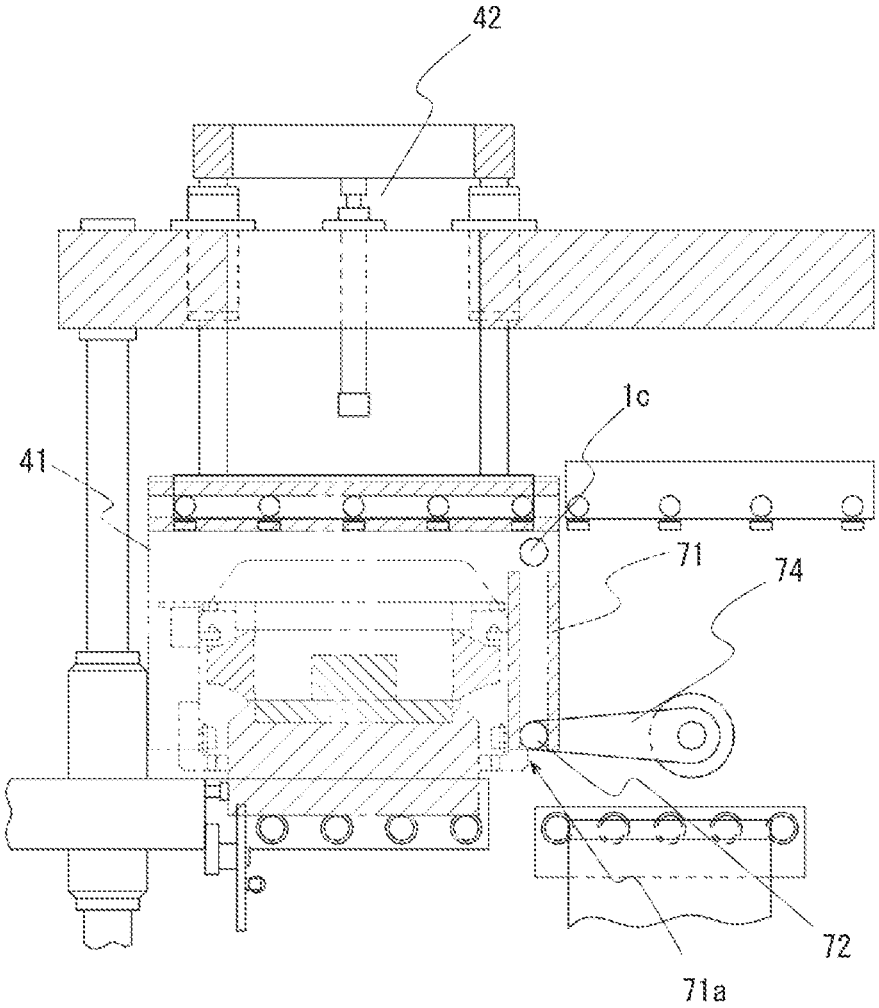
FIG. 16 is a view illustrating a state in which the molding flask conveyance frame raising/lowering device is positioned at the lowering end.
Figure 17:
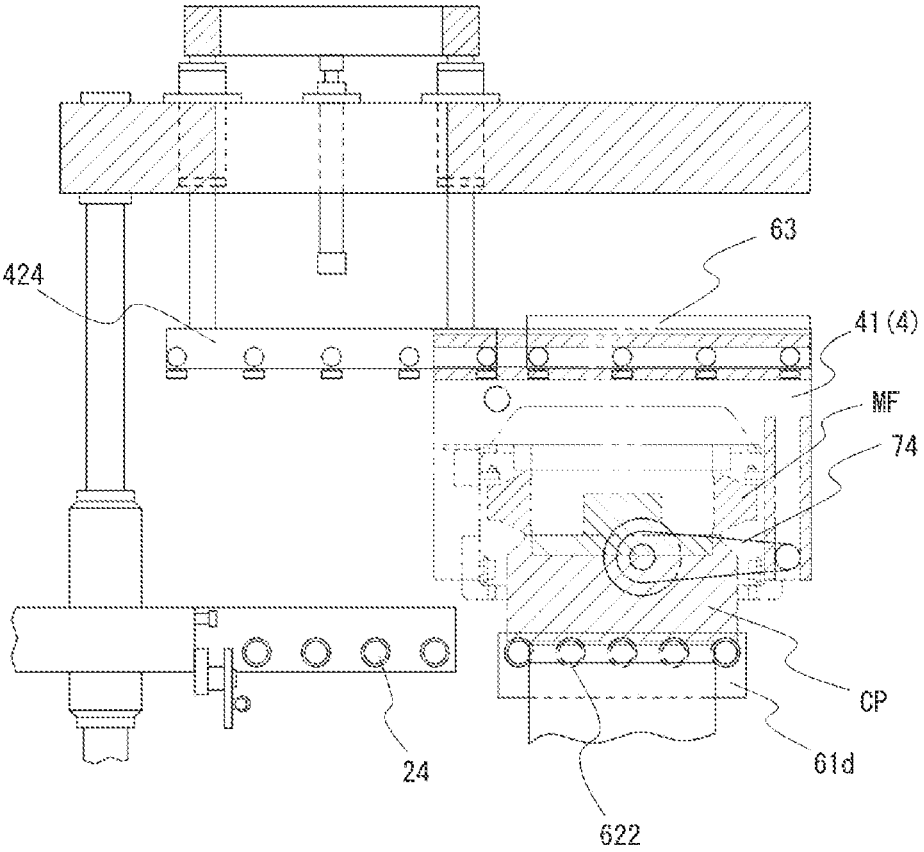
FIG. 17 is a view illustrating a state in which a crank arm is rotated to move the carrier plate, the molding flask, the upper filling frame, and the molding flask conveyance frame to a molding station.

The groove 71 is fitted to a guide roller 1*c* fixed to the lateral wall, on the upstream side, of the structure body to guide the raising/lowering operation of the molding flask conveyance frame 41 (see FIGS. 1 and 15), and the groove 71 functions as a groove 71 of a slider crank mechanism when the slider 72 described later is fitted therein (see FIGS. 16 and 17).

The slider 72 is provided at the tip of the crank arm 74 described later. The slider 72 is formed by a roller, and slides in the groove 71 through rolling or sliding.

The rotating shaft 73 is connected, via a transmission device, to an output shaft of the rotary driving device 75 fixed to the wall of the structure body. A base end of the crank arm 74 is assembled to the rotating shaft 73 so as to be relatively non-rotatable. The crank arm 74 is formed to have such an arm length that generates a stroke of half the distance by which the molding flask conveyance frame 41 moves from the molding space forming position SFP to the molding station 6.

The rotary driving device 75 is, for example, an electric motor, and the crank arm 74 is configured to be rotatable normally and reversely by the transmission device mentioned above. As the crank arm 74 rotates normally and reversely, the molding flask conveyance frame 41 moves back and forth between the molding space forming position SFP and the molding station 6. The operation of the rotary driving device 75 is controlled by the control device (not illustrated).

The molding flask carrier plate stacking device 4 (mainly, the molding flask conveyance frame 41) is moved by the rotation of the crank arm 74, and a force applied to the lateral movement moves from a lower part to an upper part of the molding flask carrier plate stacking device 4 and moves to the lower part thereof again. As described above, a force applied to the molding flask carrier plate stacking device 4 is not uniform.

However, in the present embodiment, the upper part of the molding flask carrier plate stacking device 4 is movable while being held by the first upper roller conveyor unit 424 and an upper molding station conveyor 63. Therefore, the molding flask carrier plate stacking device 4 can laterally move in a smooth and stable manner.

(Molding Station)

In the molding station 6, the casting sand CS, filled in the stacked frame obtained by stacking the upper filling frame TF and the molding flask MF on the carrier plate CP, and is pressed at the molding position MP to mold a sand mold in the molding flask MF.

Figure 4:
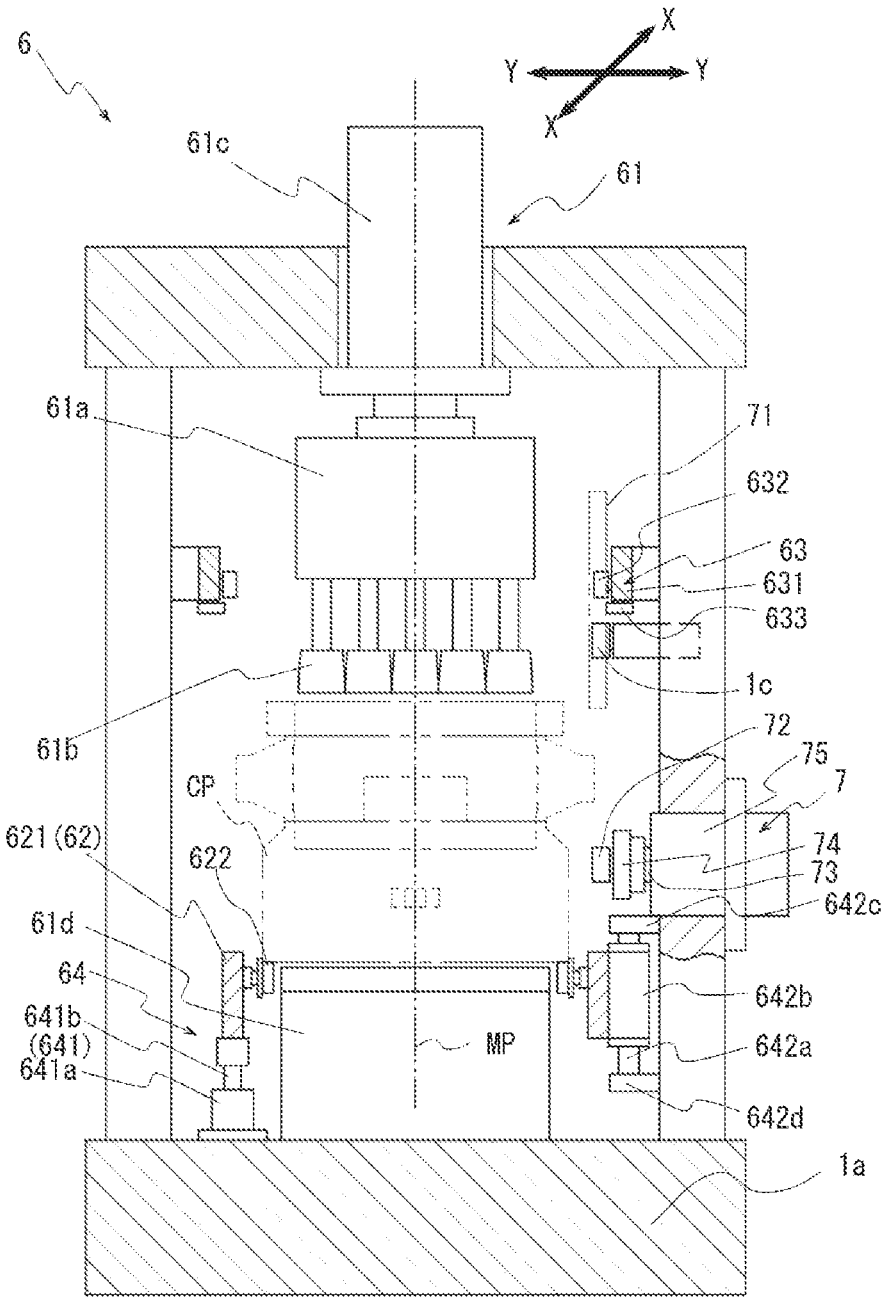
FIG. 4 is a cross-sectional view taken along line B-B in FIG. 1.

As illustrated in FIG. 4, the molding station 6 includes a casting sand pressing device 61, a molding station conveyor 62, an upper molding station conveyor 63, and a conveyor raising/lowering device 64.

(Casting Sand Pressing Device)

The casting sand pressing device 61 includes a squeezing frame 61*a*, a squeezing foot 61*b*, a hydraulic cylinder 61*c*, and a squeezing table 61*d*. Since the casting sand pressing device 61 is a publicly-known technology, and thus, detailed description thereof will be omitted.

Note that the squeezing table 61*d* according to the present embodiment is fixed to the base 1*a* of the structure body, and is provided so as to be capable of receiving the carrier plate CP on the upper surface thereof. Furthermore, the squeezing table 61*d* is arranged between opposing rollers of the molding station conveyor 62 described later.

The casting sand pressing device 61 lowers the squeezing foot 61*b* provided above the stacked frame obtained by stacking the upper filling frame TF and the molding flask MF on the carrier plate to squeeze the casting sands CS filled in the molding space.

(Molding Station Conveyor)

Figure 5:
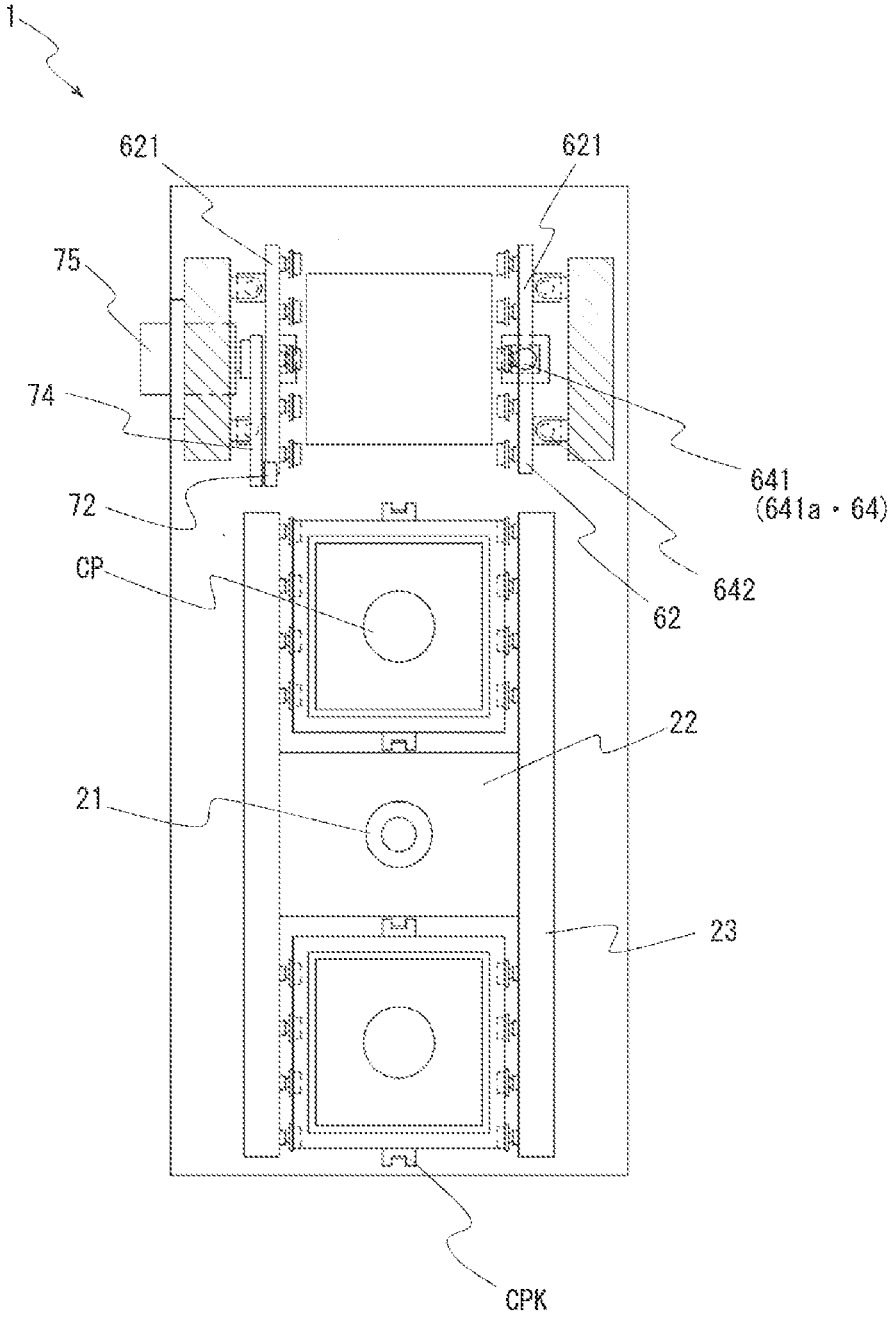
FIG. 5 is a cross-sectional view taken along line C-C in FIG. 1.
Figure 6:
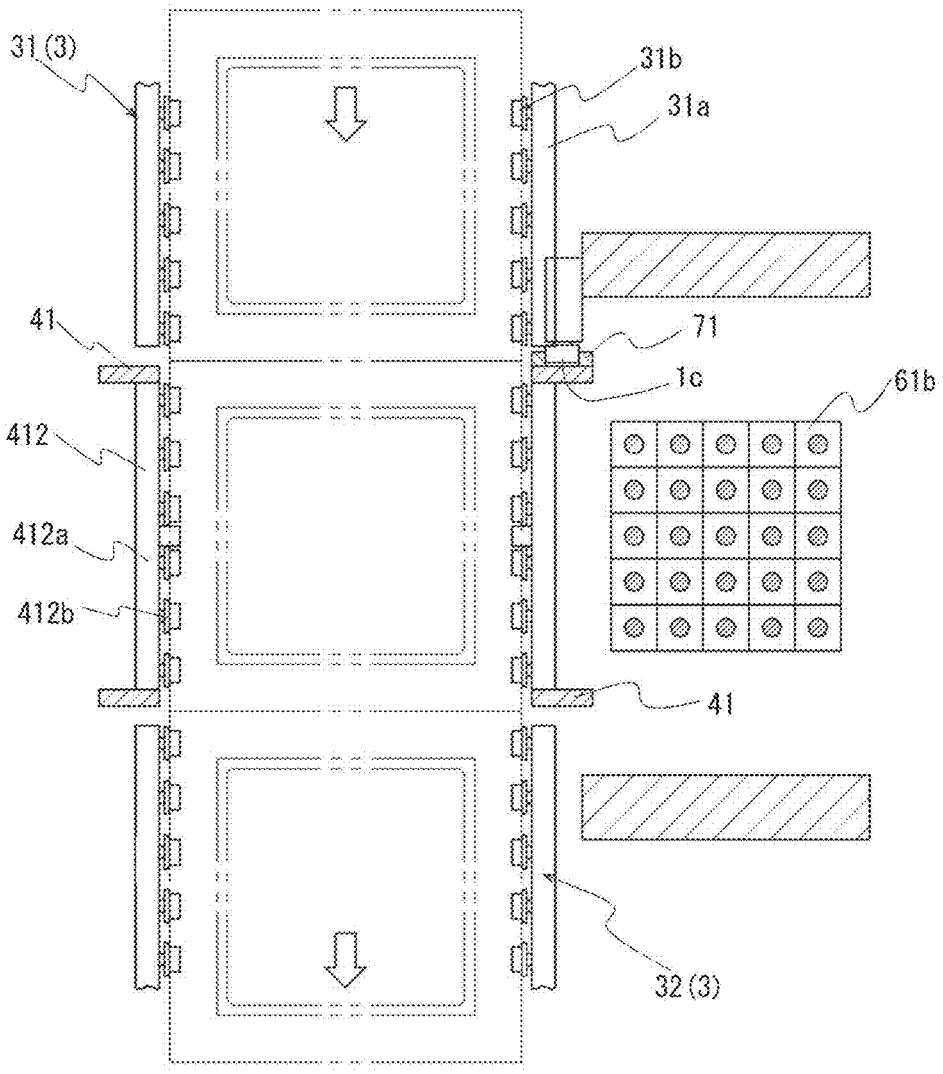
FIG. 6 is a cross-sectional view taken along line D-D in FIG. 1.

When the roller conveyor 24 (moving roller conveyor) of the carrier plate replacement device 2 is positioned at the molding space forming position SFP, the molding station conveyor 62 is aligned therewith (see FIG. 5). The molding station conveyor 62 forms a conveyance path for conveying, to the molding station 6, a stacked frame obtained by stacking the upper filling frame TF and the molding flask MF on the carrier plate CP, and charged with the casting sands CS.

The molding station conveyor 62 includes a pair of second roller support members 621 extending along the X direction, and a plurality of second rollers 622 provided side by side in the X direction on opposing inner walls of the second roller support member 621. The width of the opposing second rollers 622 is set to such a width that allows the carrier plate CP to be placed and conveyed thereon.

(Upper Molding Station Conveyor)

When the first upper roller conveyor unit 424 of the molding flask conveyance frame 41 is located in the lowering end position, the upper molding station conveyor 63 is aligned therewith. As illustrated in FIG. 4, the upper molding station conveyor 63 has second upper roller support members 631 provided on upper inner sides of two lateral walls, arranged in the Y direction, of the structure body. The upper roller support members are provided to face each other and extend along the X direction.

A plurality of rollers 632 are arranged side by side in the X direction on the inner surface of the second upper roller support member 631. Each roller 632 rotates about a rotating shaft extending in the Y direction. Each roller 632 rotates with the outer periphery thereof being in contact with the lower surface of the engagement ridge 411*a* in an upper stage.

A plurality of side rollers 633 are arranged side by side in the X direction on the lower surface of the second upper roller support member 631. Each side roller 633 rotates about a rotating shaft extending in the vertical direction. Each side roller 644 rotates with the outer periphery thereof being in contact with the tip surface of the engagement ridge 411*a* in a lower stage (see FIG. 2).

The upper molding station conveyor 63 receives the molding flask conveyance frame 41 from the first upper roller conveyor unit 424 (together with the stacked frame obtained by stacking the upper filling frame TF and the molding flask MF on the carrier plate CP, and charged with the casting sands CS) allows the conveyance thereof to the molding position MP in the molding station 6.

(Conveyor Raising/Lowering Device)

As illustrated in FIG. 4, the conveyor raising/lowering device 64 is provided below the molding station conveyor 62.

The conveyor raising/lowering device 64 delivers a stacked frame filled with the casting sands CS and positioned at the molding position MP from the molding station conveyor 62 to the squeezing table 61*d*.

The conveyor raising/lowering device 64 includes a raising/lowering device 641 and a raising/lowering guide device 642.

The raising/lowering device 641 is configured by, for example, a hydraulic cylinder. The hydraulic cylinder is assembled to the lower surface of the central portion of the second roller support member 621 in the molding station conveyor 62 so as to be relatively immovable. The hydraulic cylinder includes a cylinder portion 641*a* fixed to the base 1*a* and a piston rod 641*b* which advances and retreats along the vertical direction through the opening of the cylinder portion 641*a*.

The raising/lowering guide device 642 includes a guide rod 642*a* and a sliding pipe 642*b*. The guide rod 642*a* is provided, in a lower part inside the lateral wall, to extend along the vertical direction between an upper stopper 642*c* and a lower stopper 642*d* protruding inward. The sliding pipe 642*b* is externally fitted to the guide rod 642*a* in a slidable manner, and is assembled to the lateral surfaces of both ends of the second roller support member 621 in the molding station conveyor 62 so as to be relatively immovable.

When the piston rod 641*b* of the conveyor raising/lowering device 64 is at the rising end, the position of the upper end portion of the outer periphery of the second roller 622 in each molding station conveyor 62 is set to be higher than the upper surface of the squeezing table 61*d*.

When the piston rod 641*b* of the conveyor raising/lowering device 64 is at the lowering end, the position of the upper end portion of the outer periphery of the second roller 622 in each molding station conveyor 62 is set to be lower than the upper surface of the squeezing table 61*d*. When the casting sands CS are pressed by the casting sand pressing device 61, the conveyor raising/lowering device 64 lowers the upper end portion of the second roller 622 of the molding station conveyor 62 to a position lower than the upper surface of the squeezing table 61*d*.

The respective cylinder portion 641*a* are communicated with the hydraulic pump via an oil feeding pipe (not illustrated). An electromagnetic switching valve is provided between the cylinder portion 641*a* and the hydraulic pump. The operation of switching the electromagnetic switching valve is controlled by the control device (not illustrated).

(Operation)

An operation of the casting mold shaping device 1 configured as discussed above will be described below with reference to FIG. 1 and FIGS. 7-17.

In FIG. 1, the carrier plate CP is positioned at the molding space forming position SFP.

Above the carrier plate CP, the molding flask conveyance frame 41 is positioned at the rising end position by the molding flask conveyance frame raising/lowering device 42. The molding flask conveyance frame 41 holds the upper filling frame TF and the molding flask MF.

The sand weighing unit 52 of the casting sand filling device 5 stores therein the casting sands CS required for one molding.

Figure 7:
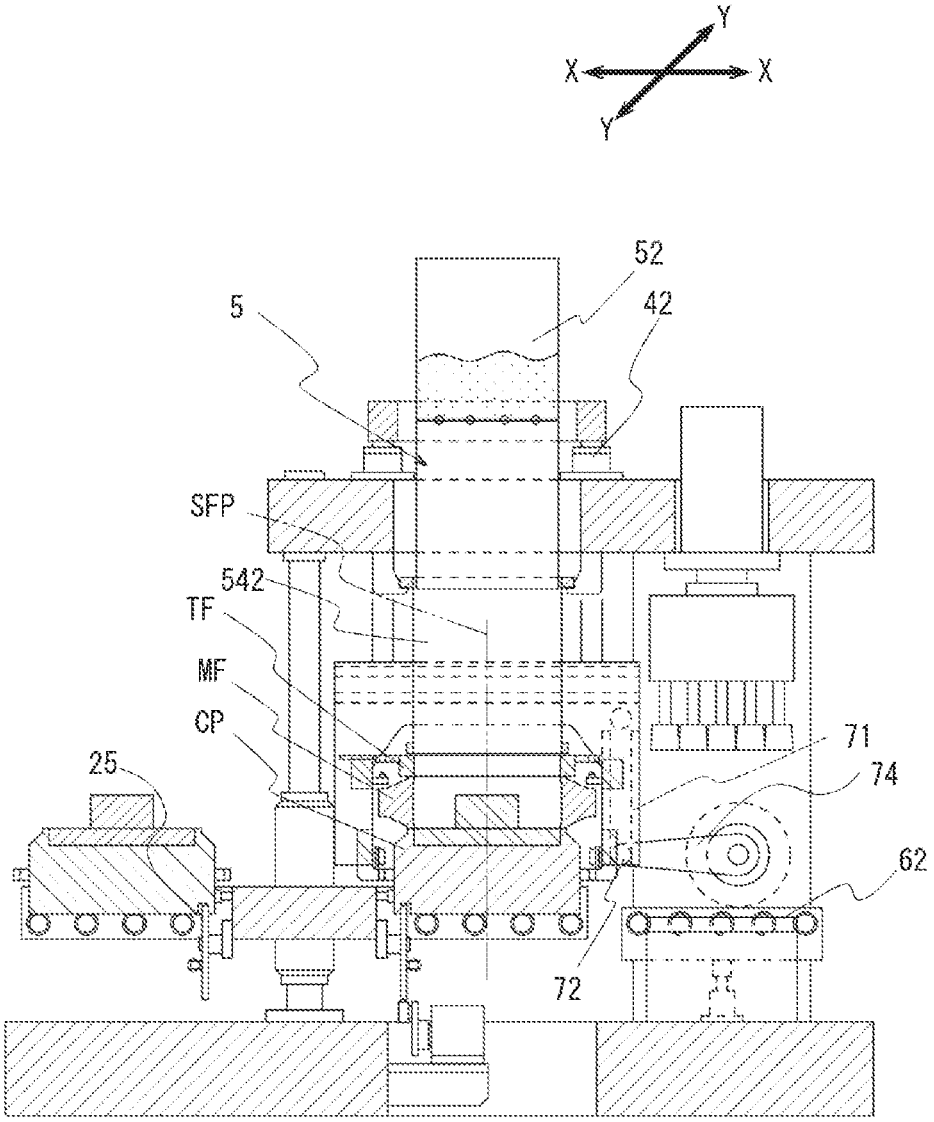
FIG. 7 is a view illustrating a state in which a stacked frame is formed by stacking a molding flask and an upper filling frame with a carrier plate.

Next, as illustrated in FIG. 7, the control device lowers the molding flask conveyance frame 41 to stack the upper filling frame TF and the molding flask MF with the carrier plate CP to obtain a stacked frame, thereby forming a molding space. At this time, the slider 72 provided at the tip of the crank arm 74 of the stacking device transfer mechanism 7 is inserted by the insertion portion 71*a* of the groove 71. The molding flask conveyance frame 41 and the carrier plate CP can be integrally moved by the side slip preventing device 43.

Figure 8:
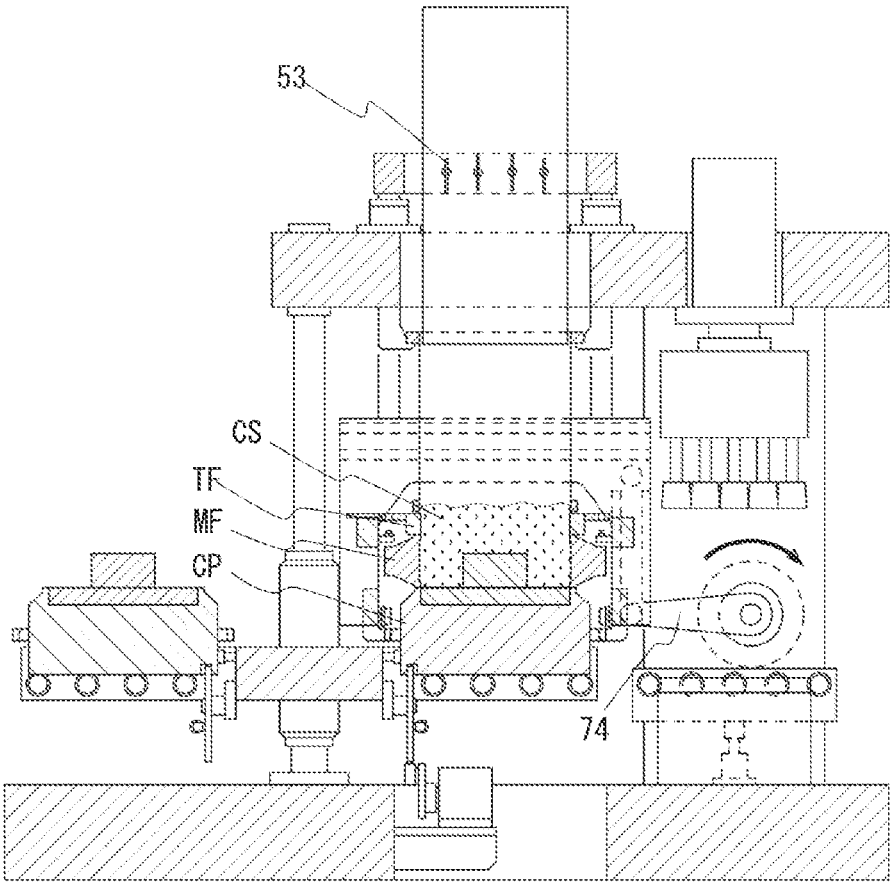
FIG. 8 is a view illustrating a state in which casting sands are charged to a molding space of the stacked frame and a state in which a slider is inserted to a groove.

Next, as illustrated in FIG. 8, the control device rotates the gate plate 53 by 90 degrees to cause the casting sands CS in the sand weighing unit 52 to freely fall and charge the casting sands CS to the molding space. Next, the control device rotates the crank arm 74 of the stacking device transfer mechanism 7 clockwise by 180 degrees in FIG. 8. As illustrated in FIGS. 16 and 17, the upper filling frame TF and the molding flask MF stacked with the carrier plate CP are reliably and promptly transferred to the molding position MP in the molding station 6 in an integrally stacked state by the molding flask conveyance frame 41. The molding flask conveyance frame is smoothly conveyed through a connection between the first upper roller conveyor unit 424 and the upper molding station conveyor 63, and the carrier plate CP is smoothly conveyed through a connection between the roller conveyor (moving roller conveyor 24) and the molding station conveyor 62.

Figure 9:
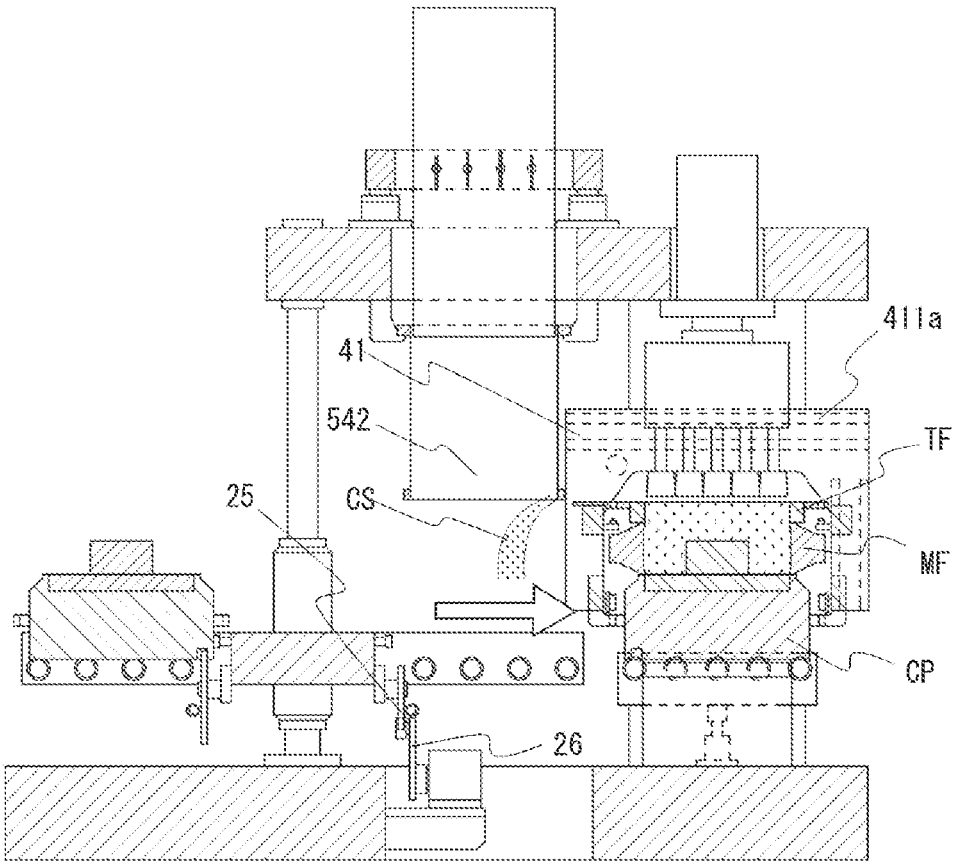
FIG. 9 is a view illustrating a state in which a molding flask and an upper filling frame stacked on the carrier plate, and a molding flask conveyance frame are transferred to a molding station.

During the movement, as illustrated in FIG. 9, the excess of the casting sands CS protruding from the upper filling frame TF is removed by the lower end portion of the second shooter part 542 so as to level off the upper surface.

Figure 10:
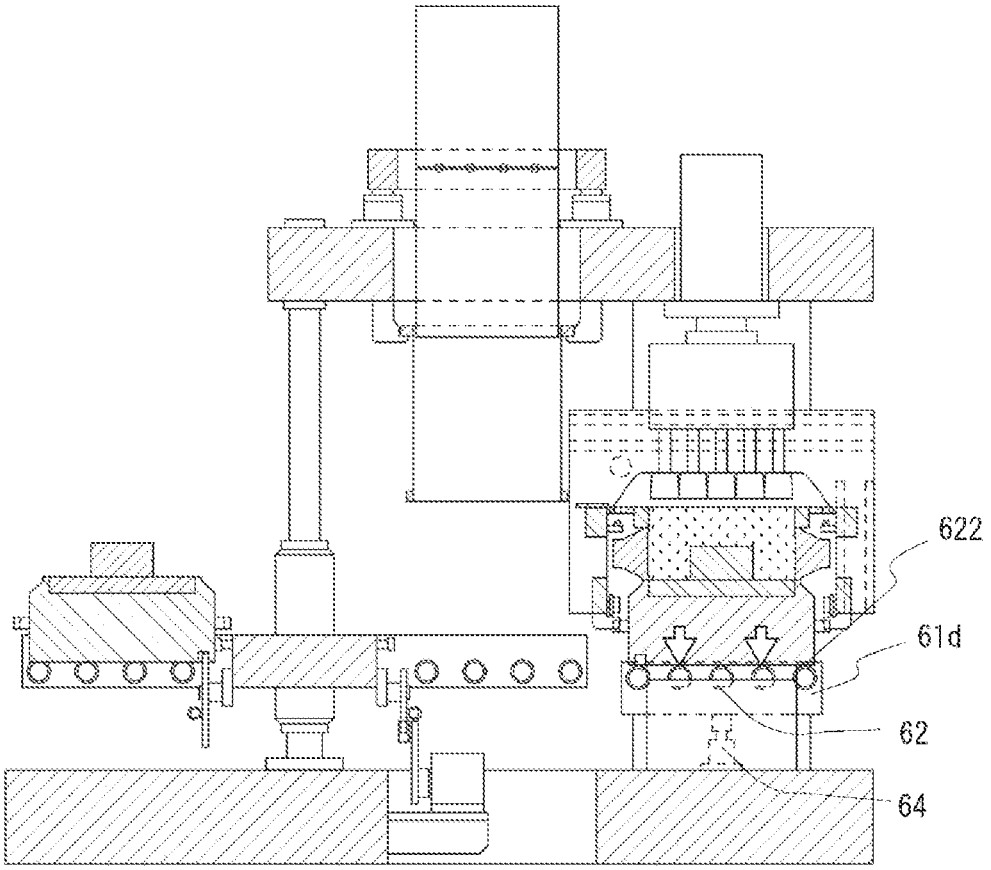
FIG. 10 is a view illustrating a state in which a molding station conveyor is lowered and the carrier plate is delivered to a squeezing table.

As illustrated in FIG. 10, the control device causes the conveyor raising/lowering device 64 to lower the molding station conveyor 62. The lowering is performed such that the upper end portion of the second roller 622 in the molding station conveyor 62 becomes lower than the upper surface of the squeezing table 61*d*.

Figure 11:
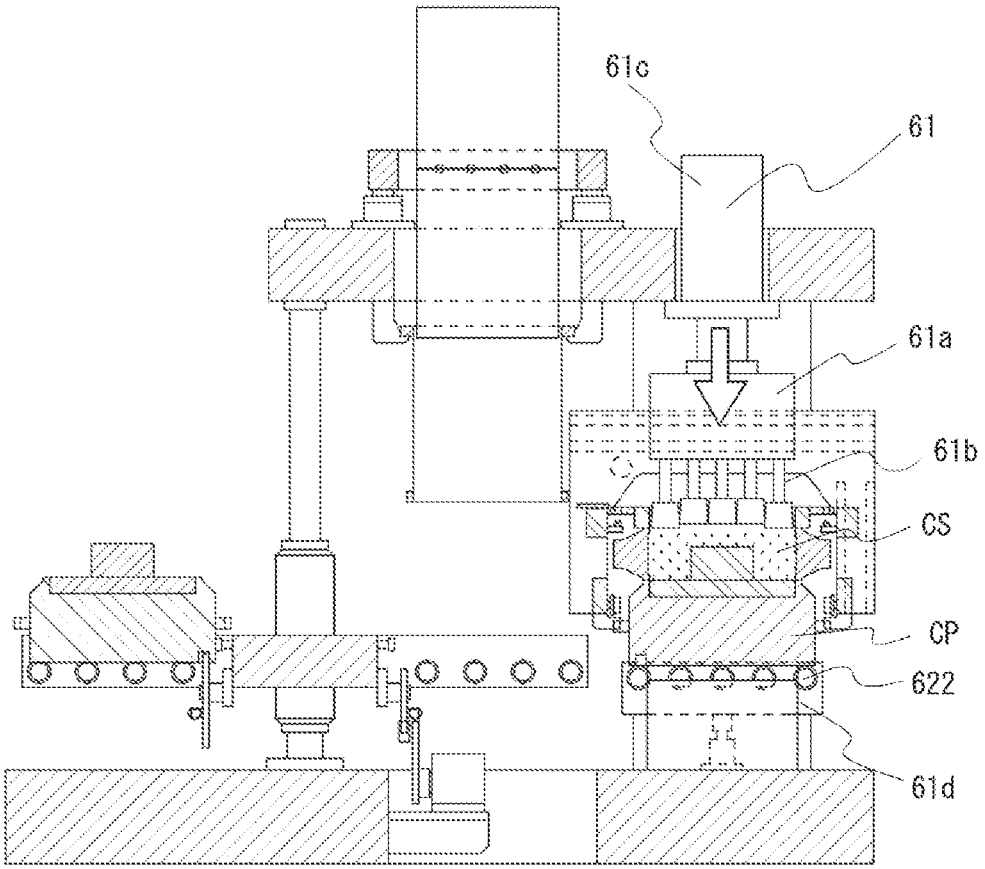
FIG. 11 is a view illustrating a state in which casting sands in the stacked frame are squeezed by a casting sand pressing device.

Next, as illustrated in FIG. 11, the control device drives the casting sand pressing device 61 to squeeze the casting sands CS filled in the molding space.

Figure 12:
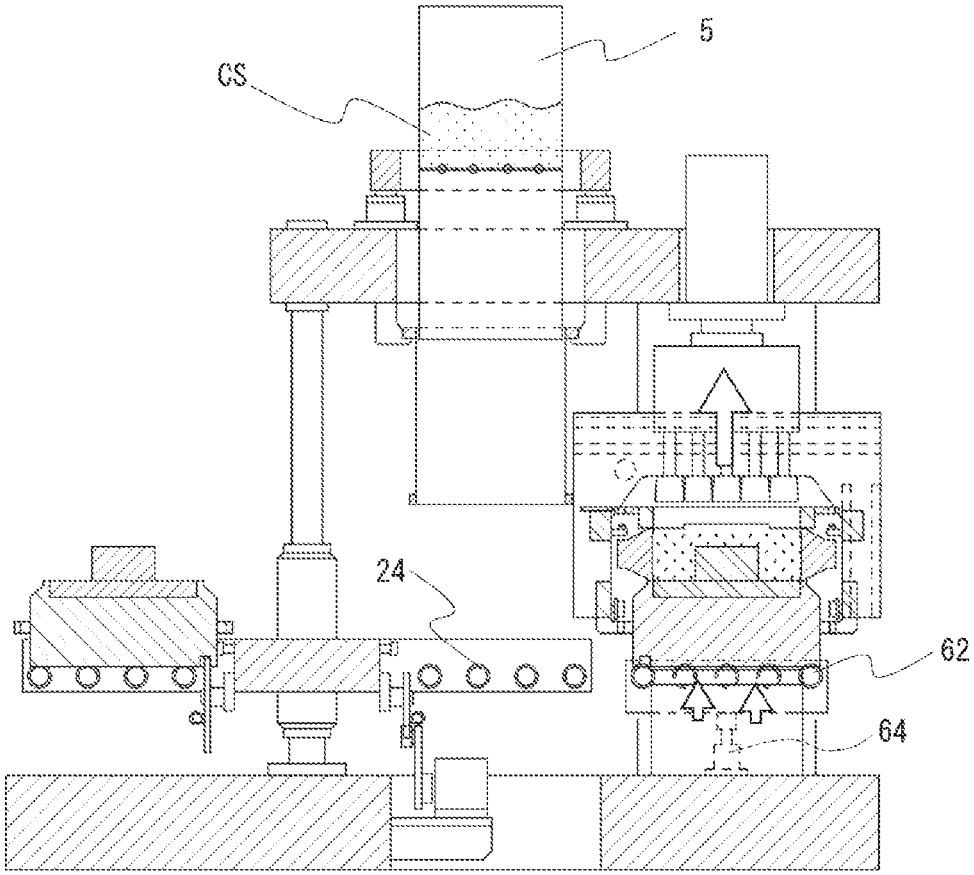
FIG. 12 is a view illustrating a state in which a squeezing foot of the casting sand pressing device is raised and the molding station conveyor is raised to an original position.

Next, as illustrated in FIG. 12, the control device raises the squeezing foot 61*b* of the casting sand pressing device 61. At this time, the molding station conveyor 62 is raised to receive the carrier plate CP, the molding flask MF after molding, and the upper filling frame TF from the squeezing table 61*d*. The height of the molding station conveyor 62 is raised to coincide with the roller conveyor (moving roller conveyor 24).

Figure 13:
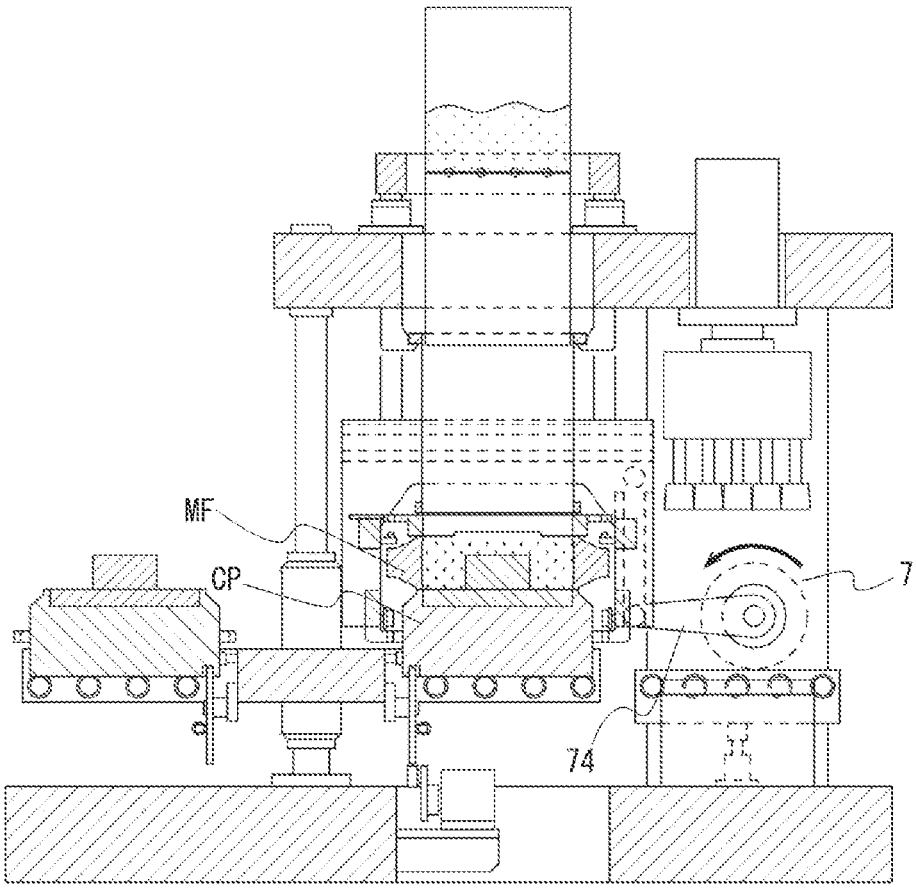
FIG. 13 is a view illustrating a state in which a crank arm is rotated to move the carrier plate, the molding flask after molding, the upper filling frame, and the molding flask conveyance frame to a molding space forming position.

Next, the control device rotates the crank arm 74 counterclockwise by 180 degrees as illustrated in FIG. 13. As a result, the molding flask MF and the upper filling frame TF stacked on the carrier plate CP and the molding flask conveyance frame 41 integrated therewith move from the molding station 6 to the molding space forming position SFP.

Figure 14:
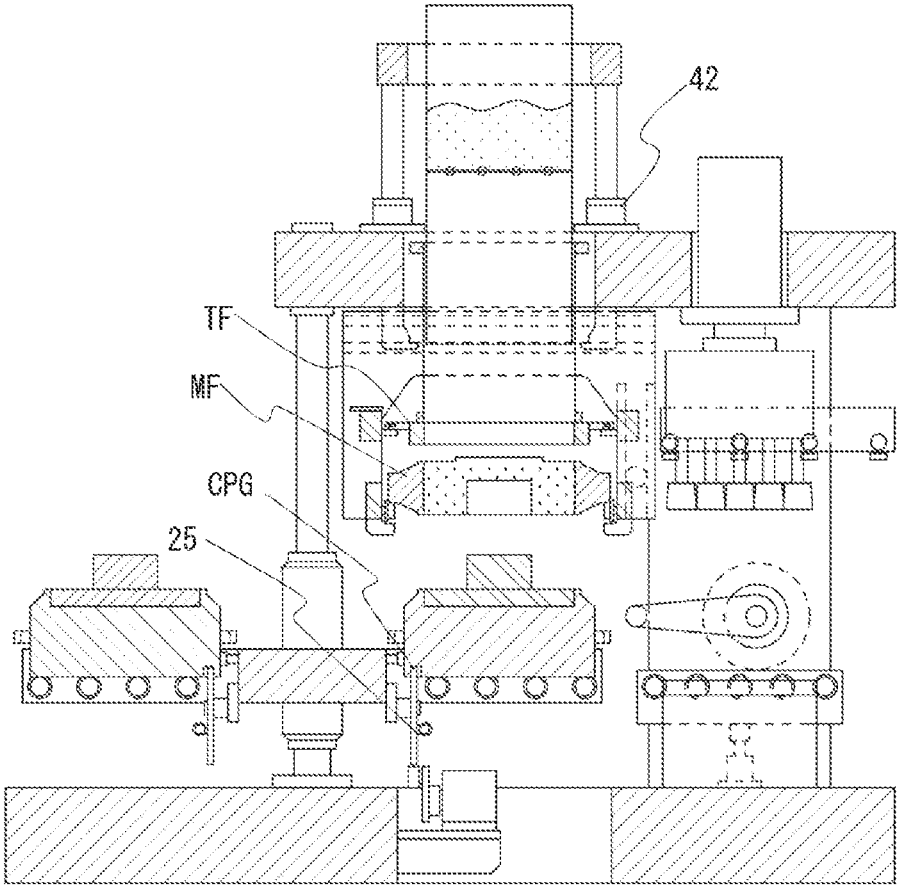
FIG. 14 is a view illustrating a state in which the molding flask after molding and the upper filling frame are separated from the carrier plate by a molding flask conveyance frame raising/lowering device.
Figure 15:
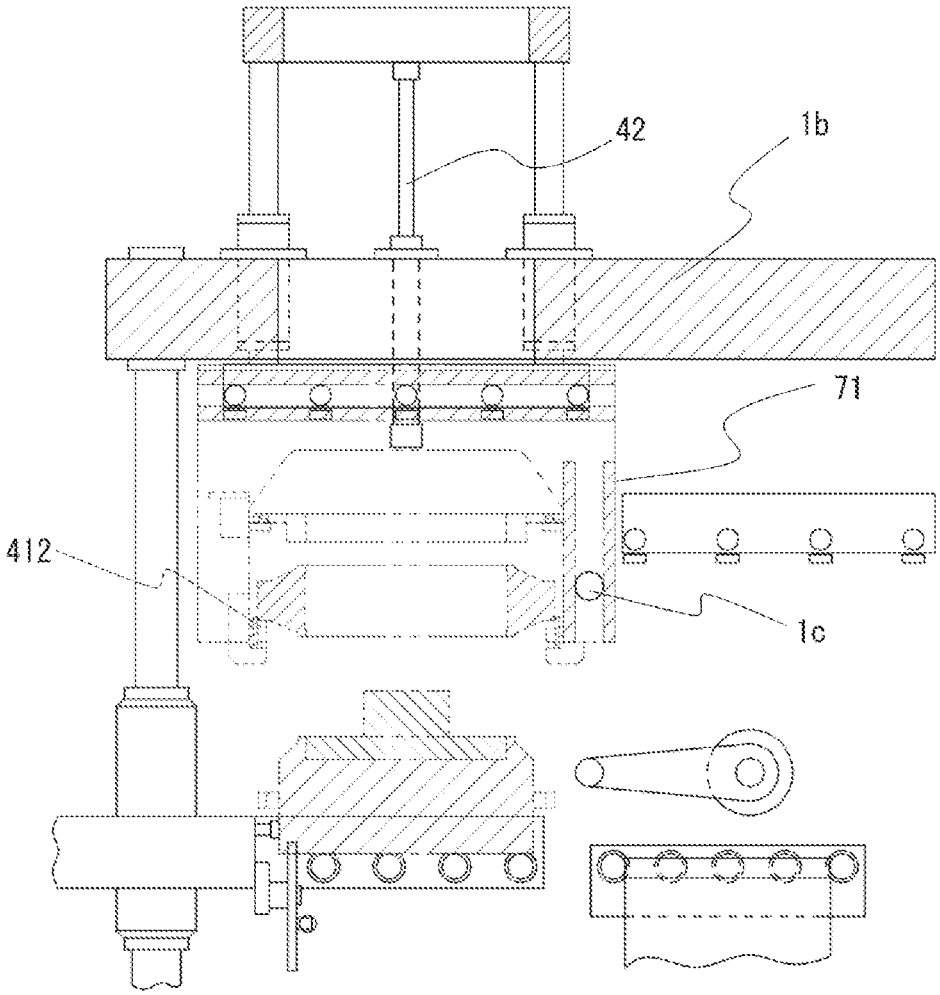
FIG. 15 is a view illustrating a state in which the molding flask conveyance frame raising/lowering device is positioned at the rising end.

Next, as illustrated in FIG. 14, the control device drives the molding flask conveyance frame raising/lowering device 42 to raise the molding flask conveyance frame 41. In the step during which the molding flask conveyance frame 41 is raised, the molding flask MF is demolded from the carrier plate CP, and the upper filling frame TF is removed from the molding flask MF.

The molding flask MF after molding is conveyed to the subsequent step by the molding flask carry-out device 32, and the upper filling frame TF is returned to the holding position of the upper filling frame TF.

As for the carrier plate CP, a new carrier plate CP is positioned at the molding space forming position SFP by the carrier plate replacement device 2.

To replace a carrier plate CP disposed at the auxiliary work position AWP with a new carrier plate CP, the carrier plate to be carried out for the replacement is moved, by the carry-out device (not illustrated), upward or in the lateral direction of being removed from the carrier plate replacement device after the locking device is released by, for example, the releasing device (not illustrated).

Hereafter, the step is repeated in the same manner.

As is obvious from the above description, the casting mold shaping device 1 according to the present embodiment includes a carrier plate replacement device 2 for mounting an upper molding flask carrier plate UCP at one position on a virtual horizontal plane and a lower molding flask carrier plate DCP at the other position on the horizontal plane, and replacing the upper molding flask carrier plate UCP and the lower molding flask carrier plate DCP by turning along the horizontal plane between an auxiliary work position AWP at which an auxiliary work is performed on each carrier plate CP and a molding space forming position SFP at which a molding space for charging casting sands CS is formed by stacking a molding flask MF on each carrier plate CP.

A molding flask carry-in/out device 3 for carrying in the molding flask MF before molding to be stacked on each carrier plate CP to the molding space forming position SFP and carrying out the molding flask MF after molding from which a mold is made, and a molding flask carrier plate stacking device 4 for stacking the molding flask MF carried in by the molding flask carry-in/out device 3 and each carrier plate CP to form the molding space, are also provided.

Additionally, a casting sand filling device 5 for charging the casting sands CS to the formed molding space, and a molding station 6 provided so as to be adjacent to the molding space forming position SFP and including a casting sand pressing device 61 for pressing the casting sands CS charged to the molding space to make a mold, are provided.

Furthermore, a molding flask carrier plate moving device for moving the carrier plate CP and the molding flask MF in stacking state from the molding space forming position SFP to the molding station 6, is provided.

Thereby, only the step of pressing the casting sands CS is performed in the molding station 6, and it is possible to shorten the stroke of the casting sand pressing device 61 in the molding station 6 and reduce wasteful power.

Furthermore, it is possible to perform the replacement work of the carrier plate CP and the auxiliary work at one place, that is an auxiliary work position AWP, thereby improving the work efficiency.

Additionally, the molding station 6 is placed on a straight line formed by the auxiliary work position AWP and the molding space forming position SFP.

Thereby, it is possible to perform the auxiliary work on the carrier plate CP to be replaced at the auxiliary work position AWP, and carry in the molding flask MF and the carrier plate CP which have been stacked in the molding space forming position SFP, to the molding station 6 in the shortest distance and the shortest time without a useless path.

A side slip preventing device 43 is provided, at the molding space forming position SFP, for preventing, when the molding flask MF and the carrier plate CP are stacked, the molding flask MF and the carrier plate CP in stacking state from slipping from each other in a horizontal direction.

Thereby, it is possible to prevent the molding flask MF and the carrier plate CP which have been stacked from horizontally slipping when being moved to the molding station 6.

Additionally, the side slip preventing device 43 is provided in the molding flask carrier plate stacking device 4.

Thereby, since the side slip preventing device 43 is provided in the molding flask carrier plate stacking device 4, it is possible to easily and reliably prevent side slip without providing a special dedicated device.

Additionally, the molding flask carrier plate moving device includes a stacking device transfer mechanism 7 for moving the molding flask carrier plate stacking device 4, together with the molding flask MF and the carrier plate CP which have been stacked, to the molding station 6.

Thereby, at the time of shifting from the raising/lowering operation for stacking the molding flask MF on the carrier plate CP to the traverse operation, transfer performed by a separate device is not required, whereby it is possible to shorten the transfer time and simplify the apparatus.

Furthermore, the molding station 6 is provided with a molding station conveyor 62, which is a roller conveyor extending in a direction of the carrier plate replacement device 2, and a moving roller conveyor 24 that aligns with the molding station conveyor 62 when having been positioned at the molding space forming position SFP is provided at a position, in the carrier plate replacement device 2, for mounting the carrier plate CP.

Thereby, it is possible to easily and reliably move the molding flask MF and the carrier plate CP in a state where the molding flask MF is being stacked on the carrier plate CP, between the molding space forming position SFP and the molding station 6.

Furthermore, the stacking device transfer mechanism 7 includes a groove 71 having an insertion portion 71*a* at an end and provided in the molding flask carrier plate stacking device 4 so as to extend in a longitudinal direction, a slider 72 that is inserted from the insertion portion 71*a* and slides along the groove 71, a rotating shaft 73 provided in a structure body of the molding station 6, a crank arm 74 that rotates about the rotating shaft 73 along a virtual vertical plane including the groove 71 between the molding space forming position SFP and the molding station 6, and causes the slider 72 to move back and forth in the groove 71, and a rotary driving device 75 that rotates the crank arm 74.

Additionally, the slider 72 is inserted to the groove 71 from the insertion portion 71*a* when the molding flask MF is stacked on the carrier plate CP.

Thereby, when the molding flask MF is stacked on the carrier plate CP, the slider 72 is inserted to the groove 71, and the molding flask MF, the carrier plate CP, and the molding flask carrier plate stacking device 4 are movable toward the molding station 6 due to the rotation of the crank arm 74. In this manner, it is possible to instantaneously communicate the lowering operation and the lateral movement operation of the molding flask MF, and perform the lateral movement operation to the molding station 6 quickly and reliably.

Additionally, the casting sand pressing device 61 in the molding station 6 lowers the squeezing foot 61*b* (corresponding to the casting sand pressing member) provided above the molding flask MF to squeeze the casting sands CS.

Thereby, since the casting sand pressing device 61 applies pressure to the casting sands CS by lowering the squeezing foot 61*b* from above the molding flask MF stacked on the carrier plate CP, there is no need for a space in which a driving device (for example, a squeezing table and a large cylinder device for raising the squeezing table) below the carrier plate CP, whereby space saving is achieved, and the pit depth for accommodating such a driving device can be shortened. In addition, since a large pressing device is located on the ground, maintainability is also improved.

Furthermore, the carrier plate replacement device 2 includes, at a position where each carrier plate CP is to be mounted, a locking device 25 that prevents the movement of each carrier plate CP outwardly in a radial direction which occurs when the carrier plate replacement device 2 is turning.

Thereby, it is possible to prevent the radial movement of the carrier plate CP due to a centrifugal force when the carrier plate replacement device 2 turns by the locking device 25.

Additionally, the molding station 6 is provided with a squeezing table 61*d* capable of receiving, on an upper surface thereof, the molding flask MF and the carrier plate CP which have been stacked, and a conveyor raising/lowering device 64 that lowers the molding station conveyor 62 to a position lower than the upper surface of the squeezing table when the casting sands CS are pressed by the casting sand pressing device 61.

Thereby, it is possible to avoid an overload on the molding station conveyor 62 as the carrier plate CP seats on the upper surface of the squeezing table 61*d* at the time of pressing the casting sands CS. Furthermore, the casting sand filling device 5 is provided so as to fit the molding space forming position SFP.

Thereby, it would be particularly easy to install a free-fall-type casting sand filling device 5 by placing the casting sand filling device 5 at the molding space forming position SFP, and it is possible to scrap off excess sands after the completion of charging when the molding flask MF and the carrier plate CP which have been stacked are moved to the molding station 6, without providing a special mechanism. Additionally, the casting mold shaping method includes a carrier plate replacement step for mounting an upper molding flask carrier plate UCP at one position on a virtual horizontal plane and a lower molding flask carrier plate DCP at the other position on the horizontal plane, and replacing the upper molding flask carrier plate UCP and the lower molding flask carrier plate DCP by turning along the horizontal plane between an auxiliary work position AWP at which an auxiliary work is performed on each carrier plate and a molding space forming position SFP at which a molding space for charging casting sands CS is formed by stacking a molding flask MF on each carrier plate CP.

A molding flask carry-in step for carrying in the molding flask MF before molding to be stacked on each carrier plate CP to the molding space forming position SFP by a molding flask carry-in device 31, a molding flask carrier plate stacking step for stacking the molding flask MF carried in by the molding flask carry-in device 31 and each carrier plate CP to form the molding space, and a casting sand filling step for filling the formed molding space with the casting sands CS, are also provided.

Furthermore, a molding flask carrier plate moving step for moving the carrier plate CP and the molding flask MF in stacking state to the molding station 6 provided so as to be adjacent to the molding space forming position SFP, and a casting sand pressing step for pressing the casting sands CS charged to the molding space to make a mold by using a casting sand pressing device 61 provided in the molding station 6, are also provided.

Thereby, only the step of pressing the casting sands CS is performed in the molding station 6, and it is possible to shorten the stroke of the casting sand pressing device 61 in the molding station 6 and reduce wasteful power.

Furthermore, it is possible to perform the replacement work of the carrier plate CP and the auxiliary work at one place, that is an auxiliary work position AWP, thereby improving the work efficiency.

Second Embodiment

Next, a second embodiment of the casting mold shaping device will be described below with reference to FIGS. 18 and 19.

In a casting mold shaping device 101 according to the second embodiment, a casting sand filling device (blow tank 110) is disposed in a molding station MP, and a molding space is filled with casting sands CS by so-called blowing performed by applying pressure thereto with compressed air.

Therefore, the casting mold shaping device 101 has a configuration different from that of the first embodiment.

Hereinafter, differences from the first embodiment will be mainly described.

Figure 18:
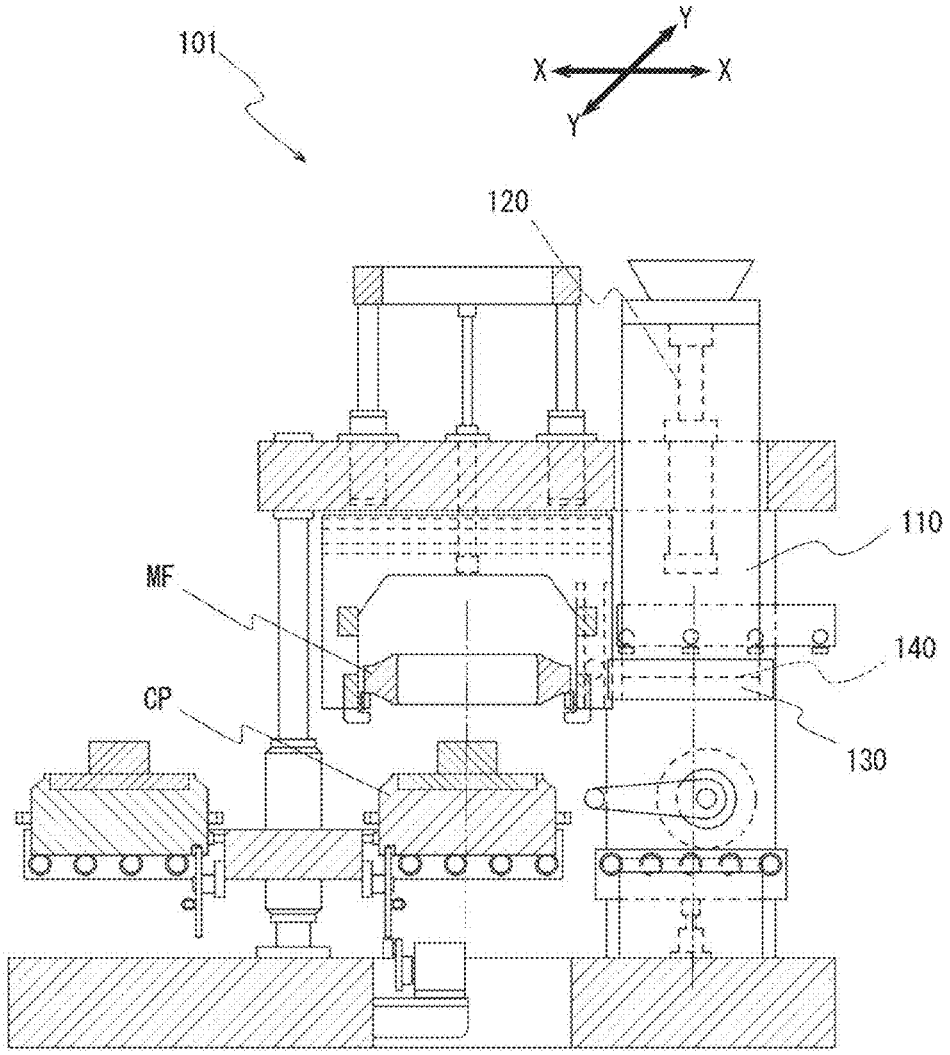
FIG. 18 is a schematic view illustrating a casting mold shaping device in a second embodiment.
Figure 19:
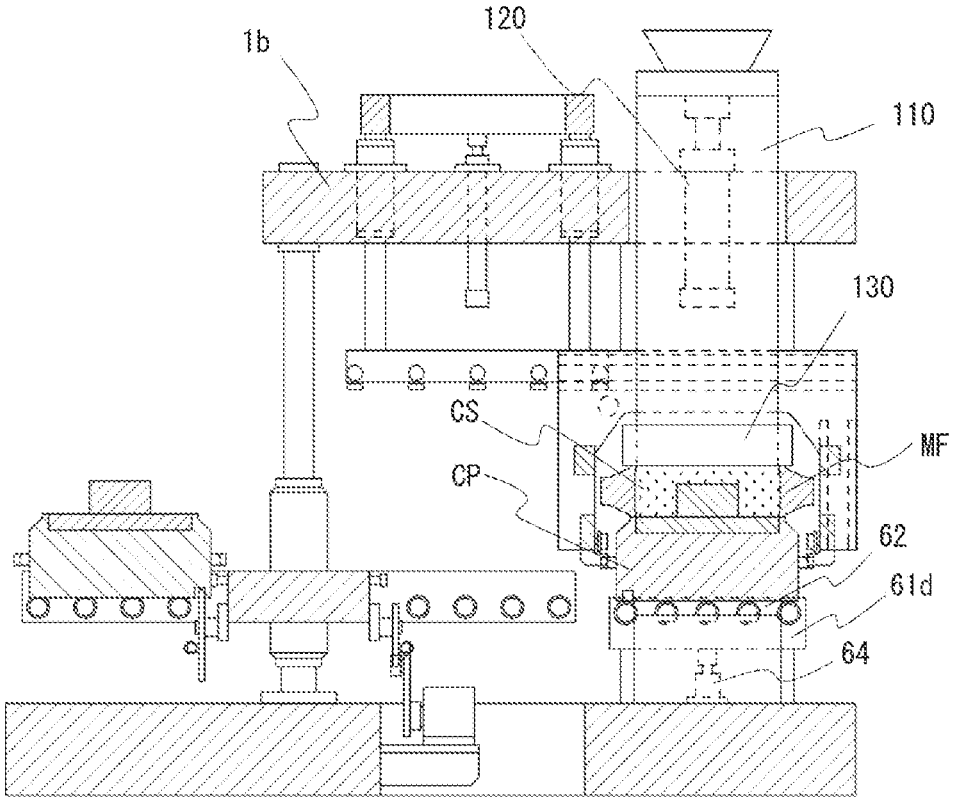
FIG. 19 is a view illustrating a molding step of the casting mold shaping device in the second embodiment.

As illustrated in FIG. 18, the casting mold shaping device 101 according to the second embodiment includes a blow tank 110, a squeezing cylinder 120, a filling frame 130, and a squeezing plate 140.

The blow tank 110 is lowered so that the filling frame 130 is stacked on the carrier plate CP and the molding flask MF.

Then, an air pump is driven to blow out the casting sands CS from a sand blowout hole to fill the molding space formed by the carrier plate CP, the molding flask MF, and the filling frame 130.

Subsequently, the blow tank 110 is further lowered, and the casting sands CS filled in the molding space are squeezed by the squeezing plate 140 integrated with the blow tank 110.

Thereby, it would be easy to install a blowing-type casting sand filling device by placing the casting sand filling device (blow tank 110) in the molding station MP, and it is possible to avoid the occurrence of excess sands after the completion of charging.

Note that, in a casting sand pressing device 61, the casting sands CS are performed by a hydraulic cylinder 61*c*, but embodiments of the present invention are not limited thereto. For example, an electric cylinder, a pneumatic cylinder, or the like may be used.

A rotary driving device 75 of the stacking device transfer mechanism 7 is an electric motor, but is not limited thereto. For example, it is possible to use a hydraulic motor or a pneumatic motor.

In the casting sand pressing device 61, the squeezing foot 61*b* is lowered to perform pressing from above, but embodiments of the present invention is not limited thereto. For example, pressing may be performed from below by raising the squeezing table, or pressing may be performed in two stages, i.e. from above and from below (double squeezing method).

Although the present invention has been disclosed in the form of embodiments and variations thereon, it will be understood that numerous additional modifications and variations could be made thereto without departing from the scope of the invention.

For the sake of clarity, it is to be understood that the use of "a" or "an" throughout this application does not exclude a plurality, and "comprising" does not exclude other steps or elements. The mention of a "unit" or a "module" does not preclude the use of more than one unit or module.

REFERENCE SIGNS LIST

1 casting mold shaping device
2 carrier plate replacement device

24 roller conveyor (moving roller conveyor)
25 locking device
26 releasing device
3 molding flask carry-in/out device
31 molding flask carry-in device
4 carrier plate stacking device
41 molding flask conveyance frame
412 roller conveyor unit
413 upper filling frame holding unit
42 molding flask conveyance frame raising/lowering device
424 first upper roller conveyor unit
43 side slip preventing device
5 casting sand filling device
6 molding station
61 casting sand pressing device
61*b* squeezing foot (casting sand pressing member)
61*d* squeezing table
62 molding station conveyor
63 upper molding station conveyor
64 conveyor raising/lowering device
7 stacking device transfer mechanism
71 groove
71*a* insertion portion
72 slider
73 rotating shaft
74 crank arm
75 rotary driving device
101 casting mold shaping device
110 blow tank (casting sand filling device)
120 squeezing cylinder (casting sand pressing device)
130 filling frame
140 squeezing plate (casting sand pressing member)
AWP auxiliary work position
CP carrier plate
CPG to-be-locked groove
CPK to-be-engaged portion
CS casting sand
DCP lower molding flask carrier plate
UCP upper molding flask carrier plate
MF molding flask
MP molding casting position
SFP molding space forming position
TF upper filling frame

The invention claimed is:

1. A casting mold shaping device, comprising:

a carrier plate replacement device for mounting an upper molding flask carrier plate at one position on a virtual horizontal plane and a lower molding flask carrier plate at another position on the horizontal plane, and replacing the upper molding flask carrier plate and the lower molding flask carrier plate by turning along the virtual horizontal plane between an auxiliary work position at which an auxiliary work is performed on each of the carrier plates and a molding space forming position at which a molding space for filling casting sands is formed by stacking a molding flask on each of the carrier plates;

a molding flask carry-in/out device for carrying in the molding flask before molding to be stacked on each of the carrier plates to the molding space forming position and carrying out the molding flask after molding from which a mold is made;

a molding flask carrier plate stacking device for stacking the molding flask carried in by the molding flask carry-in/out device and each of the carrier plates to form the molding space;

a casting sand filling device for filling the formed molding space with the casting sands;

a molding station provided so as to be adjacent to the molding space forming position and including a casting sand pressing device for pressing the casting sands charged to the molding space to make a mold; and a molding flask carrier plate moving device for moving the carrier plate and the molding flask in stacking state from the molding space forming position to the molding station.

2. The casting mold shaping device according to claim 1, wherein the molding station is placed on a straight line formed by the auxiliary work position and the molding space forming position.

3. The casting mold shaping device according to claim 1, wherein a side slip preventing device is provided, at the molding space forming position, for preventing, when the molding flask and the carrier plate are stacked, the molding flask and the carrier plate in stacking state from slipping from each other in a horizontal direction.

4. The casting mold shaping device according to claim 3, wherein the side slip preventing device is provided in the molding flask carrier plate stacking device.

5. The casting mold shaping device according to claim 4, wherein the molding flask carrier plate moving device comprises a stacking device transfer mechanism for moving the molding flask carrier plate stacking device, together with the molding flask and the carrier plate which have been stacked, to the molding station.

6. The casting mold shaping device according to claim 5, wherein the stacking device transfer mechanism comprises:

a groove having an insertion portion at an end and provided in the molding flask carrier plate stacking device so as to extend in a longitudinal direction;

a slider that is inserted from the insertion portion and slides along the groove;

a rotating shaft provided in a structure body of the molding station;

a crank arm that rotates about the rotating shaft along a virtual vertical plane including the groove between the molding space forming position and the molding station, and causes the slider to move back and forth in the groove; and a rotary driving device that rotates the crank arm, and the slider is inserted to the groove from the insertion portion when the molding flask is stacked on the carrier plate.

7. The casting mold shaping device according to claim 1, wherein the molding station is provided with a molding station conveyor, which is a roller conveyor extending in a direction of the carrier plate replacement device, and a moving roller conveyor that aligns with the molding station conveyor when having been positioned at the molding space forming position is provided at a position, in the carrier plate replacement device, for mounting the carrier plate.

8. The casting mold shaping device according to claim 7, wherein the carrier plate replacement device includes, at a position where each of the carrier plates is to be mounted, a locking device that prevents the movement of each of the carrier plates outwardly in a radial direction which occurs when the carrier plate replacement device is turning.

9. The casting mold shaping device according to claim 7, wherein the molding station is provided with a squeezing table capable of receiving, on an upper surface thereof, the molding flask and the carrier plate which have been stacked, and a conveyor raising/lowering device that lowers the molding station conveyor to a position lower than the upper surface of the squeezing table when the casting sands are pressed by the casting sand pressing device.

10. The casting mold shaping device according to claim 1, wherein the casting sand pressing device in the molding station lowers a casting sand pressing member provided on an upper side of the molding flask to squeeze the casting sands.

11. The casting mold shaping device according to claim 1, wherein the casting sand filling device is provided so as to fit the molding space forming position.

12. The casting mold shaping device according to claim 1, wherein the casting sand filling device is provided so as to fit a position of the molding station.

13. A casting mold shaping method comprising:

a carrier plate replacement step for mounting an upper molding flask carrier plate at one position on a virtual horizontal plane and a lower molding flask carrier plate at another position on the horizontal plane, and replacing the upper molding flask carrier plate and the lower molding flask carrier plate by turning along the virtual horizontal plane between an auxiliary work position at which an auxiliary work is performed on each of the carrier plates and a molding space forming position at which a molding space for filling casting sands is formed by stacking a molding flask on each of the carrier plates;

a molding flask carry-in step for carrying in the molding flask before molding to be stacked on each of the carrier plates to the molding space forming position by a molding flask carry-in device;

a molding flask carrier plate stacking step for stacking the molding flask carried in by the molding flask carry-in device and each of the carrier plates to form the molding space, a casting sand filling step for filling the formed molding space with the casting sands;

a molding flask carrier plate moving step for moving the carrier plate and the molding flask in stacking state to the molding station provided so as to be adjacent to the molding space forming position; and a casting sand pressing step for pressing the casting sands charged to the molding space to make a mold by using a casting sand pressing device provided in the molding station.

* * * * *